US007703409B2

(12) United States Patent
Sinclair et al.

(10) Patent No.: US 7,703,409 B2
(45) **Date of Patent: *Apr. 27, 2010**

(54) DEVICE FOR USE AS A BOOKMARK OR FOR PROMOTIONAL PURPOSES

(75) Inventors: Iain Wortley Sinclair, Hildersham (GB); Grant Strathearn Sinclair, Hildersham (GB); Godfrey Michael Bradman, London (GB); Nicholas Miller, London (GB); Camilla Ruth Bradman, London (GB); Margaret Anne Murphy, London (GB); Paul Thomas, Leicestershire (GB)

(73) Assignee: KYP (Holdings) PLC, London (GB)

( * ) Notice: Subject to any disclaimer, the term of this patent is extended or adjusted under 35 U.S.C. 154(b) by 0 days.

This patent is subject to a terminal disclaimer.

(21) Appl. No.: 12/271,283

(22) Filed: Nov. 14, 2008

(65) Prior Publication Data

US 2009/0114145 A1 May 7, 2009

Related U.S. Application Data

(63) Continuation of application No. 10/969,243, filed on Oct. 21, 2004, now Pat. No. 7,461,613.

(30) Foreign Application Priority Data

Oct. 23, 2003 (GB) ..... 0324783.0
Jul. 23, 2004 (GB) ..... 0416503.1

(51) Int. Cl.
*B42D 9/00* (2006.01)
*B42D 15/00* (2006.01)
*G09F 11/04* (2006.01)

(52) U.S. Cl. ..... 116/234; 116/284; 116/298; 116/300; 116/318; 40/495; 40/446; 283/56

(58) Field of Classification Search ..... 116/234, 116/222–225, 235, 284, 285, 298, 300, 306, 116/307, 309, 316, 318, 319, 321, DIG. 1; 206/216, 232, 425, 455–457, 459.5, 472, 206/775–778; 40/446, 486–490, 492, 495, 40/497; 283/56, 65, 116; 281/42; 462/6; 229/71, 72, 75

See application file for complete search history.

(56) References Cited

U.S. PATENT DOCUMENTS 1,420,265 A 6/1922 Kieckhefer
1,951,022 A 3/1934 Iverson
2,012,023 A 8/1935 Richardson (Continued)

FOREIGN PATENT DOCUMENTS

EM 000088026-0001 1/2004

(Continued)

*Primary Examiner*—Amy Cohen Johnson
(74) *Attorney, Agent, or Firm*—Venable LLP; Robert Kinberg; Kyle D. Petaja

(57) ABSTRACT

A bookmark or promotional device comprises a plurality of pockets aligned side-by-side with the opening of the pocket being at the edge of the bookmark. The pockets contain advertising or other promotional material as inserts. The devices are produced in different versions for different audiences and are distributed through a variety of channels generally free of charge to customers.

8 Claims, 33 Drawing Sheets

U.S. PATENT DOCUMENTS

| | | | | |
|---|---|---|---|---|
| 2,222,272 | A | 11/1940 | Wesner | |
| 2,810,211 | A | 10/1957 | Zesbaugh | |
| 2,842,314 | A | 7/1958 | McKennett | |
| 2,887,327 | A | 5/1959 | Tucker | |
| 3,200,517 | A | 8/1965 | Amerigo | |
| 3,226,022 | A | 12/1965 | Otto | |
| 3,334,806 | A | 8/1967 | Hiersteiner | |
| 3,340,652 | A | 9/1967 | Purcell | |
| 3,399,823 | A | 9/1968 | Johnson | |
| 3,477,146 | A | 11/1969 | Warneke | |
| 3,714,399 | A | 1/1973 | Cataland | |
| 3,902,656 | A | 9/1975 | Rothchild | |
| 3,958,690 | A | 5/1976 | Gee, Sr. | |
| 3,992,795 | A | 11/1976 | Rettig | |
| 4,048,477 | A | 9/1977 | Hungerford | |
| 4,179,610 | A | 12/1979 | Chester | |
| 4,920,675 | A | 5/1990 | Mashimo et al. | |
| 5,377,612 | A | 1/1995 | Catalano et al. | |
| 5,462,006 | A | 10/1995 | Thiruppathi | |
| 5,517,007 | A | 5/1996 | Morgan | |
| 5,577,918 | A | 11/1996 | Crowell | |
| 5,582,128 | A | 12/1996 | Wollan et al. | |
| 5,669,165 | A | 9/1997 | Santorsola | |
| 5,778,578 | A | 7/1998 | Drapcho et al. | |
| 6,009,584 | A | 1/2000 | Padden | |
| 6,061,938 | A | 5/2000 | Young | |
| 6,153,039 | A | 11/2000 | Jacobsen | |
| 6,257,405 | B1 | 7/2001 | Painsith et al. | |
| 6,275,142 | B1 | 8/2001 | Paleiov et al. | |
| 6,390,015 | B1 | 5/2002 | Germano | |
| 6,393,707 | B1 | 5/2002 | Maffei et al. | |
| 6,409,360 | B2 | 6/2002 | Contant et al. | |
| 6,446,803 | B1 | 9/2002 | McKinney | |
| 6,574,188 | B1 | 6/2003 | Fliegel et al. | |
| 6,808,289 | B2 | 10/2004 | Reed | |
| 6,871,432 | B2 | 3/2005 | Lacroix et al. | |
| 7,036,254 | B1 | 5/2006 | Jones et al. | |
| 2005/0120940 | A1* | 6/2005 | Sinclair et al. | 116/234 |
| 2009/0114145 | A1* | 5/2009 | Sinclair et al. | 116/234 |

FOREIGN PATENT DOCUMENTS

| | | |
|---|---|---|
| EM | 000088026-0002 | 1/2004 |
| EM | 000088026-0003 | 1/2004 |
| EM | 000088026-0004 | 1/2004 |
| EM | 000123674-0001 | 4/2004 |
| GB | 1 292 887 | 10/1972 |
| GB | 2 335 390 | 9/1999 |
| GB | 1 337 979 | 10/1999 |
| GB | 2 336 657 | 10/1999 |

* cited by examiner

DEVICE FOR USE AS A BOOKMARK OR FOR PROMOTIONAL PURPOSES

CROSS-REFERENCE TO RELATED APPLICATION

This application is a continuation of U.S. patent application Ser. No. 10/969,243 filed Oct. 21, 2004 which claims the priority of British Application Nos. GB 0324783.0 filed Oct. 23, 2003 and GB 0416503.1 filed Jul. 23, 2004, the subject matter of the foregoing foreign applications being incorporated herein by reference.

BACKGROUND OF THE INVENTION

This invention relates to a device for use as a bookmark or for promotional purposes, which may carry advertisements, promotional material and other information.

It is desirable for advertisers to distribute advertising copy and promotional material specifically directed to particular socio-economic groups. For example, advertisements may be placed in magazines and other periodicals with advertising copy specifically tailored to the profile of the readership of the individual titles. Presently, books are published and sold on a great variety of subjects, appealing to different groups of people in society.

Hitherto, bookmarks have been proposed with features that perform more than just marking the last read page of a book. For example U.S. Pat. No. 5,462,006 discloses a bookmark with a pocket to receive photographs and potpourri whereas U.S. Pat. No. 6,446,803 discloses a bookmark attached to the spine of the book providing a pocket for inserting pens.

SUMMARY OF THE INVENTION

In accordance with the invention there is provided a device for use as a bookmark or for promotional purposes which can be used to carry advertising messages and removable items that can comprise adverting material or promotional items. When used as a bookmark, the advertising and promotional material can be specifically tailored to different subject matter book titles, and individual versions of the bookmark with specifically tailored advertising material may be distributed with books of corresponding subject matter category at their at their point of sale.

According to the invention in one aspect there is provided a generally flat device for use as a bookmark or for promotional purposes comprising: first and second cover members of sheet material one overlying the other, with generally coextensive side edges in at least a portion thereof, and at least one pocket between the cover members, the pocket having an opening defined by the side edges of the cover members, the pocket being configured to receive an insert removable through the pocket opening.

A window may be provided in at least one of the cover members to show a portion of the insert when in the pocket. The device may include a plurality of the pockets with their openings side by side and defined by the coextensive side edges. One or more wheels may be mounted for rotation between the cover members and so as to protrude from the side edges of the covers. The or each wheel may cooperate with a window in one or both of the cover members to display messages, such as the last read page number of a book or other advertising or informational messages.

The or each insert may comprise advertising or promotional material specifically directed to a target group. For example, when used as a bookmark, the groups may be based on subject matter categories for published book titles.

The invention also includes an improved method of distributing advertising material in printed publications. In more detail, the invention provides a method performed by a distribution organisation to distribute advertising material, wherein a publisher publishes different publications and the distribution organisation distributes advertising material on behalf of advertising clients for supply with copies of the publications sold to customers, the method comprising: receiving from the publisher information relating to particular ones of its publications with which advertising material is to be distributed; arranging for advertising material to be produced on behalf of advertising clients, and arranging for the advertising material to be supplied for distribution with copies of the titles sold to customers, at no cost to them; deriving a financial benefit from the advertising clients; and providing the publisher with a financial benefit dependent on the number of copies of its publications with which the advertising material is distributed.

The distribution organisation may comprise a distribution company, and the publisher may be a shareholder in the distribution company in order to encourage effective distribution of the advertising material with the published titles. Their shareholding and hence their dividend payment may be dependent on the level at which they contract to distribute the advertising material with their publications.

The invention also includes an improved method of placing the inserts into pockets of the device. According to the invention there is provided a method of placing an insert into a pocket in a generally flat device that comprises first and second generally coextensive cover members which overlie one another, the pocket having its opening between perimeter edge of the cover members and a rear that is opposite the opening between the cover members, the method comprising configuring the first and second cover members to provide access to the rear of the pocket, placing the insert into the pocket through the rear using one of the cover members as a guide surface to guide the insert into the pocket, and closing the rear.

The invention also includes an improved method of placing a wheel in the device. More particularly, the invention provides a generally flat device for use as a bookmark or for promotional purposes including a rotary wheel assembly comprising: a substrate of sheet material, a generally disc shaped rotary wheel member overlying the substrate, with an axial opening therein, a stub axle upstanding from the substrate to provide a rotational axis for the wheel, the axle having end regions proximal to and distal from the substrate, the opening in the wheel having a smaller radial dimension than the distal end region of the axle and being configured so that the wheel can be push-fitted onto the stub axle over the distal end such that when received on the axle, the wheel is captured thereon for axial rotation.

The device according to the invention may include an electronic package, which may be driven by a battery. A paper battery can be used advantageously. The package may comprise a telephone tone dialler, a timer, a light or a radio frequency identity tag (RFID) reader, or other similar component.

When the device is provided with the RFID reader, the inserts in pockets of the device may include RFID tags that can be removed by the user and placed on items to be identified, such as luggage, to be located for example on a carousel at an airport.

The device may also include other components to provide added value to the recipient; for example, a ruler, a flat pen, a compass, samples of various products, sewing kits or other utilities. These components will be packaged within the device and will generally be ultra thin and compact.

The device can be used for purposes other than as a bookmark. It can be used as a compact carrier of information which the recipient will want to keep and use and be distributed directly to the recipient in a variety of ways which could include direct mail, delivery at point of sale of related products. For example it may be included in a so-called goody bag provided to airline passengers, containing tickets and other travel documents. The device may include targeted advertising and promotional material.

BRIEF DESCRIPTION OF THE DRAWING

Embodiments of the present invention will now be described, by way of example, with reference to the accompanying drawings, in which.

DETAILED DESCRIPTION OF THE INVENTION

Figure 1:
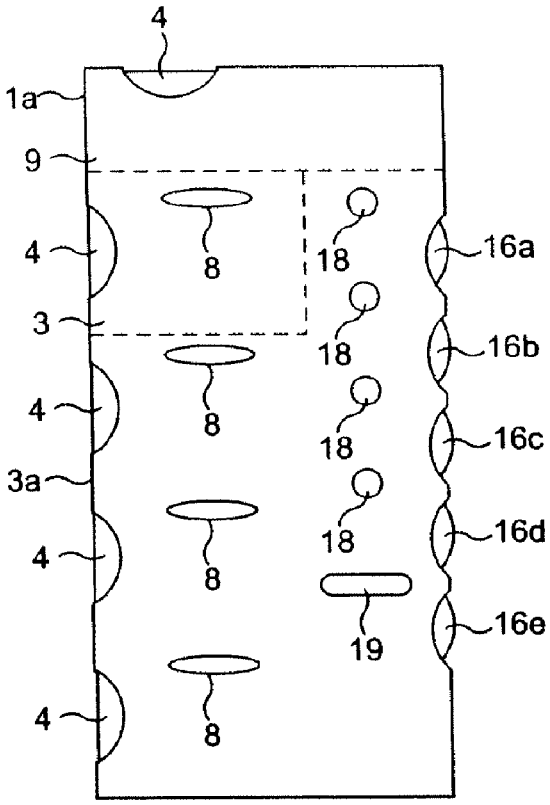
FIG. 1 is a front view of a first embodiment of a bookmark in accordance with the invention.
Figure 2:
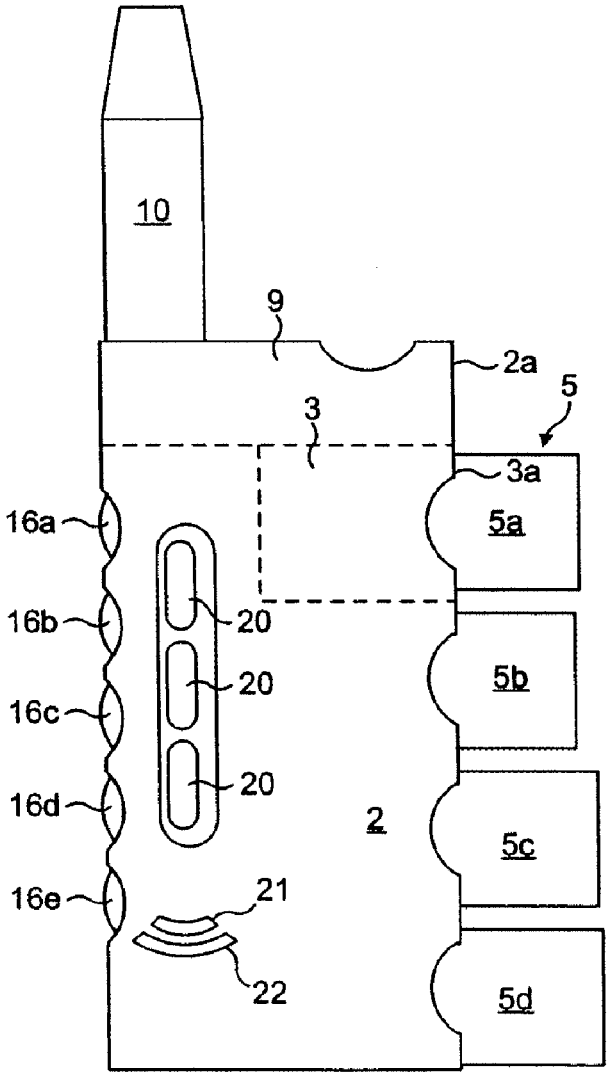
FIG. 2 is a rear view of the bookmark shown in FIG. 1.

Referring to FIGS. 1 and 2, the device comprises a first, front main cover member 1 and a second, rear main cover member 2 that overlie one another. In this embodiment, the front and rear main cover are rectangular, made of sheet material such as cardboard and are generally coextensive, with the same overall shape and size. The device is thus generally flat and so is suitable for use as a bookmark, but may also be used in other situations for use as a promotional device, as will be explained in more detail hereinafter.

Considering the device when configured for use as a bookmark (referred to hereinafter as a "bookmark" but without limitation of the more general promotional uses of the device according to the invention described and claimed hereinafter), its front and rear main cover members 1, 2 have outer faces that display text and images (not shown) that are appropriate for the book that will contain the bookmark. For example, if the bookmark is for use with a children's book, the bookmark may display information about the book or pictures of the characters in the book. Alternatively, if the bookmark is supplied with a travel book or guidebook, the bookmark may display information about travelling. The bookmark may be provided with a book when sold, for example pre-packaged within pages of the book or for presentation to a customer when the book is sold, and the displayed information on the faces of the main covers 1, 2 may be selected depending on the category of the book's title e.g. children's book, travel, medical, scientific.

The bookmark further comprises a number of sections that act as pockets 3 between the front and rear main covers 1, 2, that have openings disposed along their left hand longitudinal edge shown in FIG. 1. The covers 1, 2 have left hand side edges 1*a*, 2*a* and the pockets have openings 3*a* coextensive with the left hand side edges 1*a*, 2*a*. A recess 4 at the opening 3*a* of each pocket facilitates access to contents of the pockets 3. The pockets 3 contain inserts 5 that bear advertisements and promotional material 5*a*, 5*b*, 5*c*, 5*d*. The advertisements and promotional material may be directed to a target market that corresponds to the subject matter of the book title, so as to target particular groups of readers. The contents of the pockets are thus selected depending on the category of the book title.

The advertising material may comprise printed matter. The promotional material may take many different forms such as mini-kits of promotional samples or other thin objects that may be attractive or appealing to the target market of book readers. For example the pockets 3 may contain samples of cosmetic products or consumables. Another possibility is that the pockets contain mini kits of first aid products as an advertisement for a pharmacy, or mini stationery kits as an advertisement for a stationer.

Figure 3:
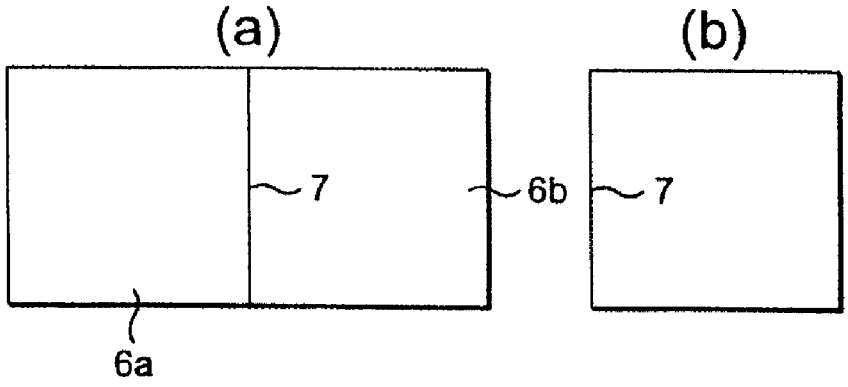
FIG. 3 is a view of inserts for the bookmark shown folded in FIG. 3*a* and unfolded in FIG. 3*b;*

The inserts 5 may be contained within an insert cover 6 that may be made from a rectangular sheet of card as shown in FIG. 3*a*, that is folded in half along line 7, creating two covers 6*a*, 6*b* that overlie one another as shown in FIG. 3*b*. Each insert cover 6*a*, 6*b* is generally the same size and shape as the pocket 3 in the bookmark. Indicia can be printed on both sides of the insert covers and mini kit products can be attached between the two covers. Alternatively, one insert cover can be configured as a sachet containing consumables. It will be understood that many different designs can be used for the inserts 5 to be placed in the pockets 3.

Figure 4:
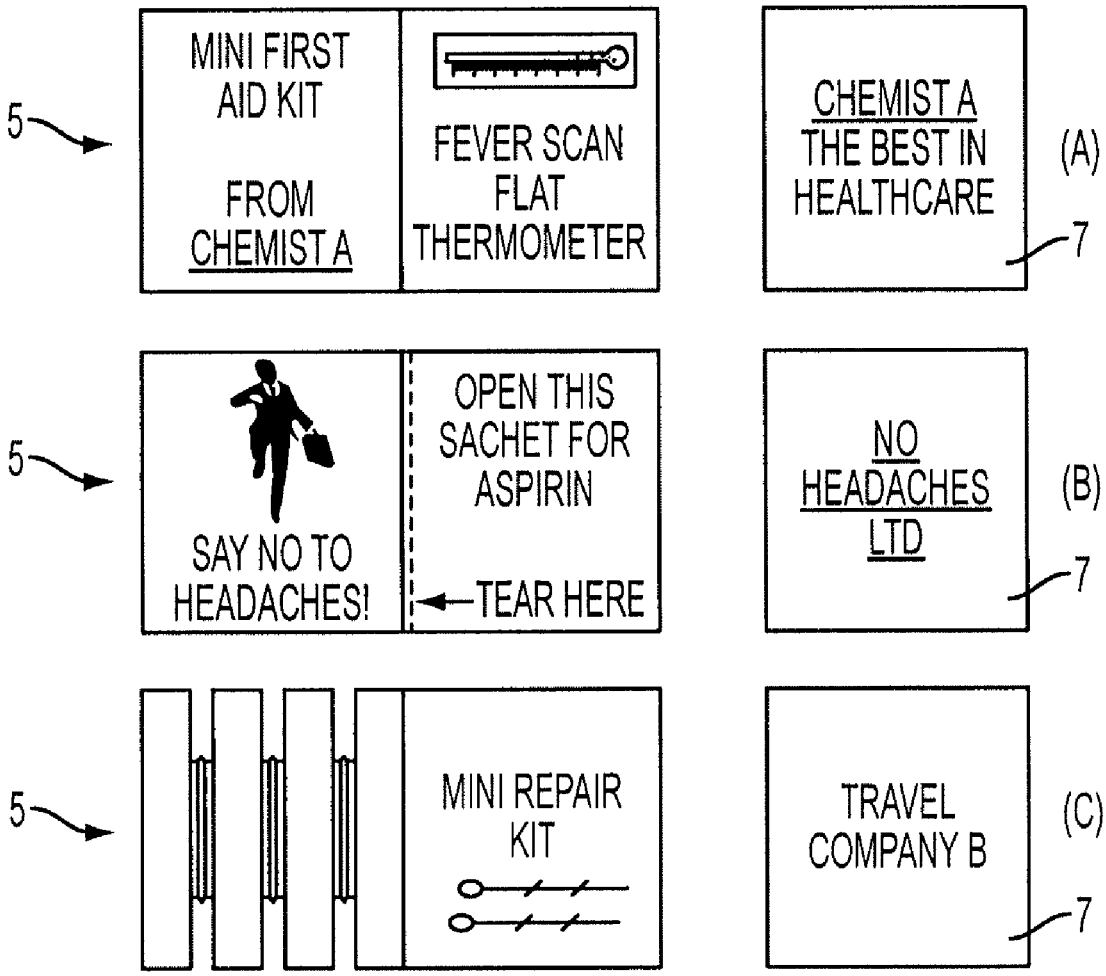
FIG. 4 illustrates three examples of the inserts.

FIG. 4 illustrates some examples of the inserts 5. FIG. 4*a* shows a mini first aid kit that includes a flat thermometer to be contained in a bookmark intended for a medical handbook. FIG. 4*b* illustrates a specific example of how one of the insert covers can be replaced by a sachet that can be torn off along the centre line 7. FIG. 4*c* is an example of an insert in the form of a repair kit to be contained in for example a guidebook to a city. The repair kit could be handy for a tourist and consequently, may be supplied free of charge by a travel agent as a marketing strategy.

As shown in FIG. 1, the front main cover 1 of the bookmark includes windows 8 which allow the reader to preview the inserts 5 placed in the pockets 3, and the inserts themselves can be configured to have a legend or similar display to be aligned with a corresponding window 8 for this purpose. For example, if the pocket contains a game, the window will show the name or the type of the game and if the pocket contains advertisement for a soda drink the window will show the name of the brand of the soda drink.

Figure 5:
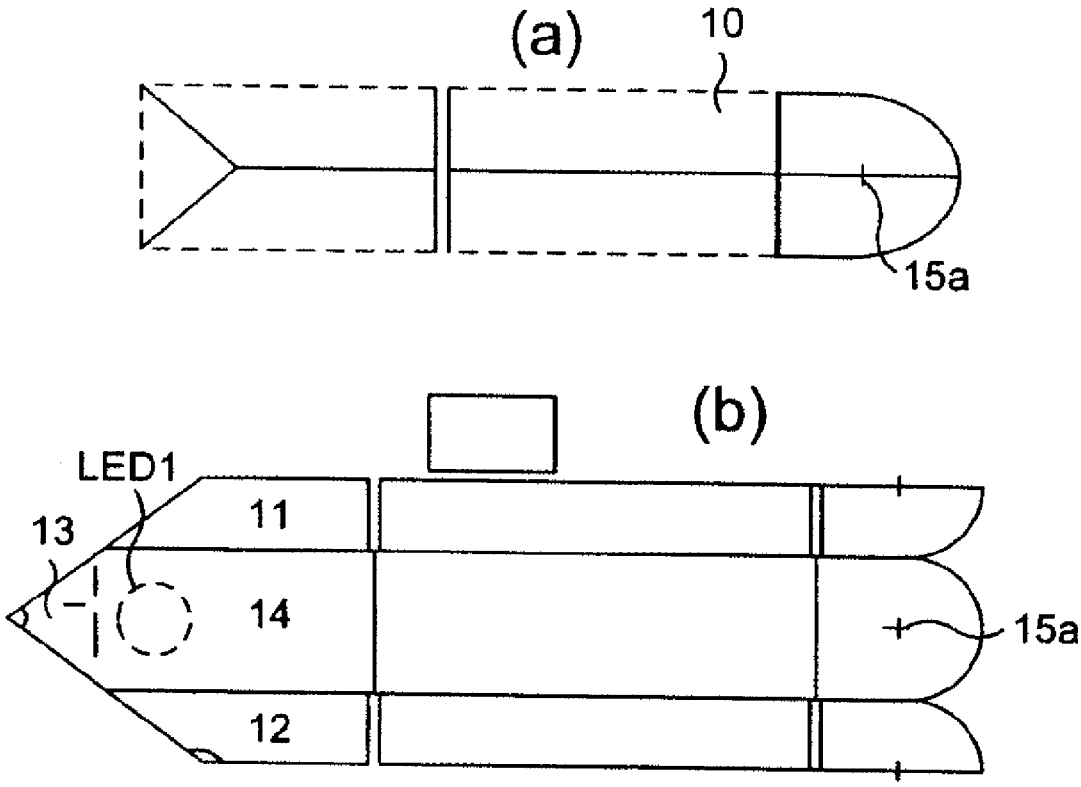
FIG. 5 illustrates an example of a foldable ruler that can be fitted in one of the pockets of the bookmark, shown unfolded in FIG. 5*a* ready to be fitted to the bookmark, and as an unfolded blank in FIG. 5*b;*
Figure 6:
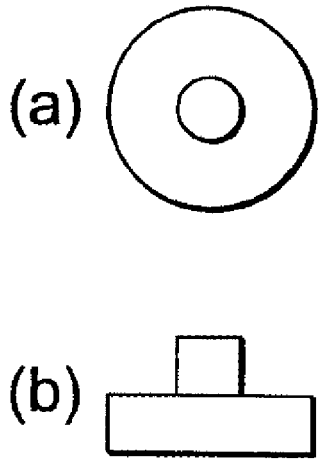
FIG. 6*a* is a plan view of one of the spindles on which the ruler and wheels pivot.
FIG. 6*b* is a corresponding side view of the spindle.

As shown in FIGS. 1 and 2, the bookmark also has a top pocket 9 to receive an implement or other item that is attractive or useful for the reader. In this example the top pocket 9 contains an extendable ruler 10 and in another embodiment it contains an extendable rectangular piece of cardboard provided with a book light. The book light may comprise a light emitting diode, battery and drive circuitry operable as described in GB Patent Specification No. 2,336,657. The ruler itself can be manufactured by folding a thin sheet of cardboard as illustrated in FIG. 5; Portions 11, 12 and 13 are folded onto portion 14 and an adhesive is used to hold the parts together. In the case of the book light, a light emitting diode LED1 is provided on the cardboard member so that it can be cantilevered into a convenient position for use by the reader. The end 15*a* of the ruler or book light pivots at point 15*b* on a spindle shown in FIG. 6, mounted on the bookmark in the position shown in FIGS. 7 and 8.

Figure 7:
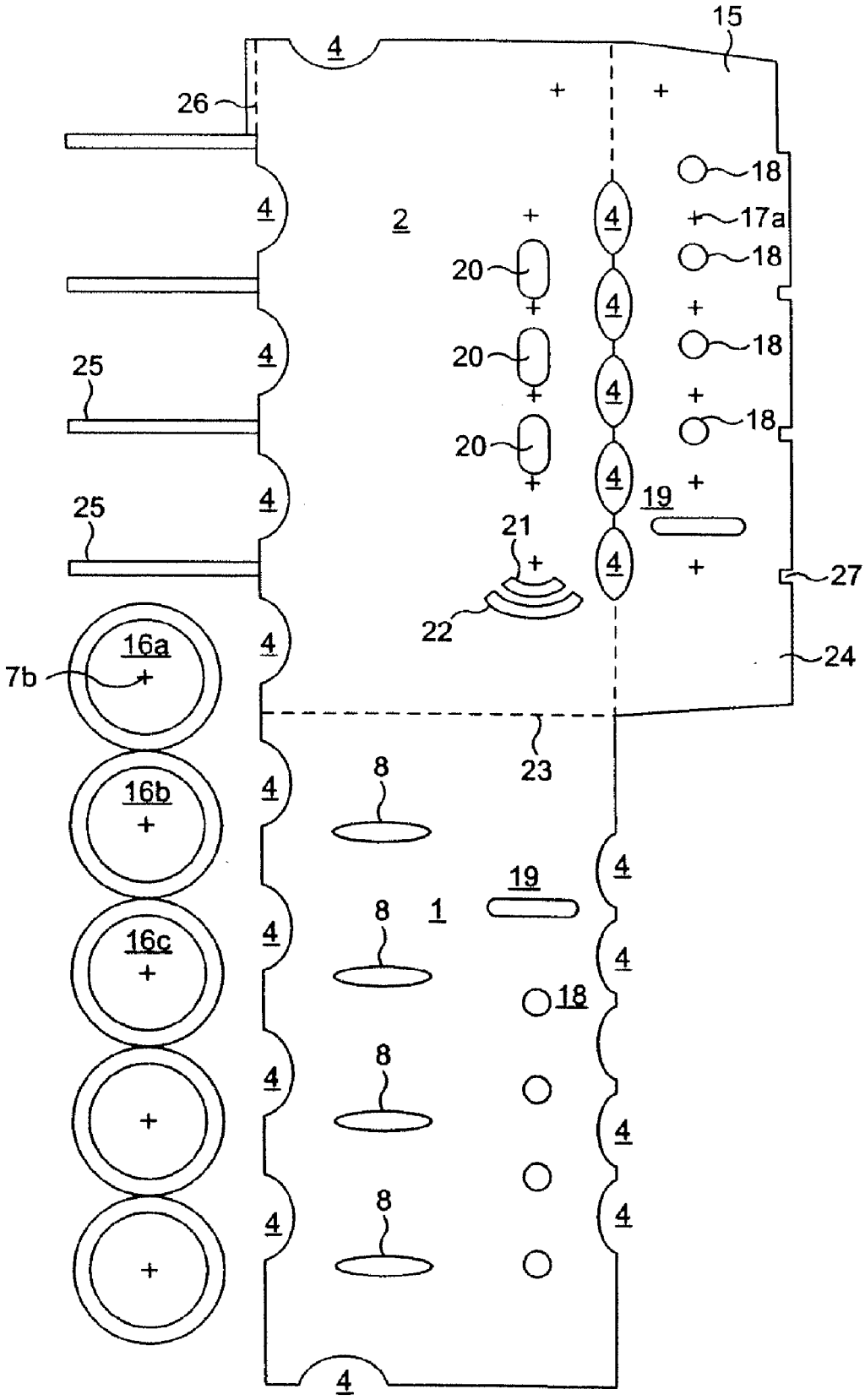
FIG. 7 illustrates components of the bookmark before it is assembled.
Figure 8:
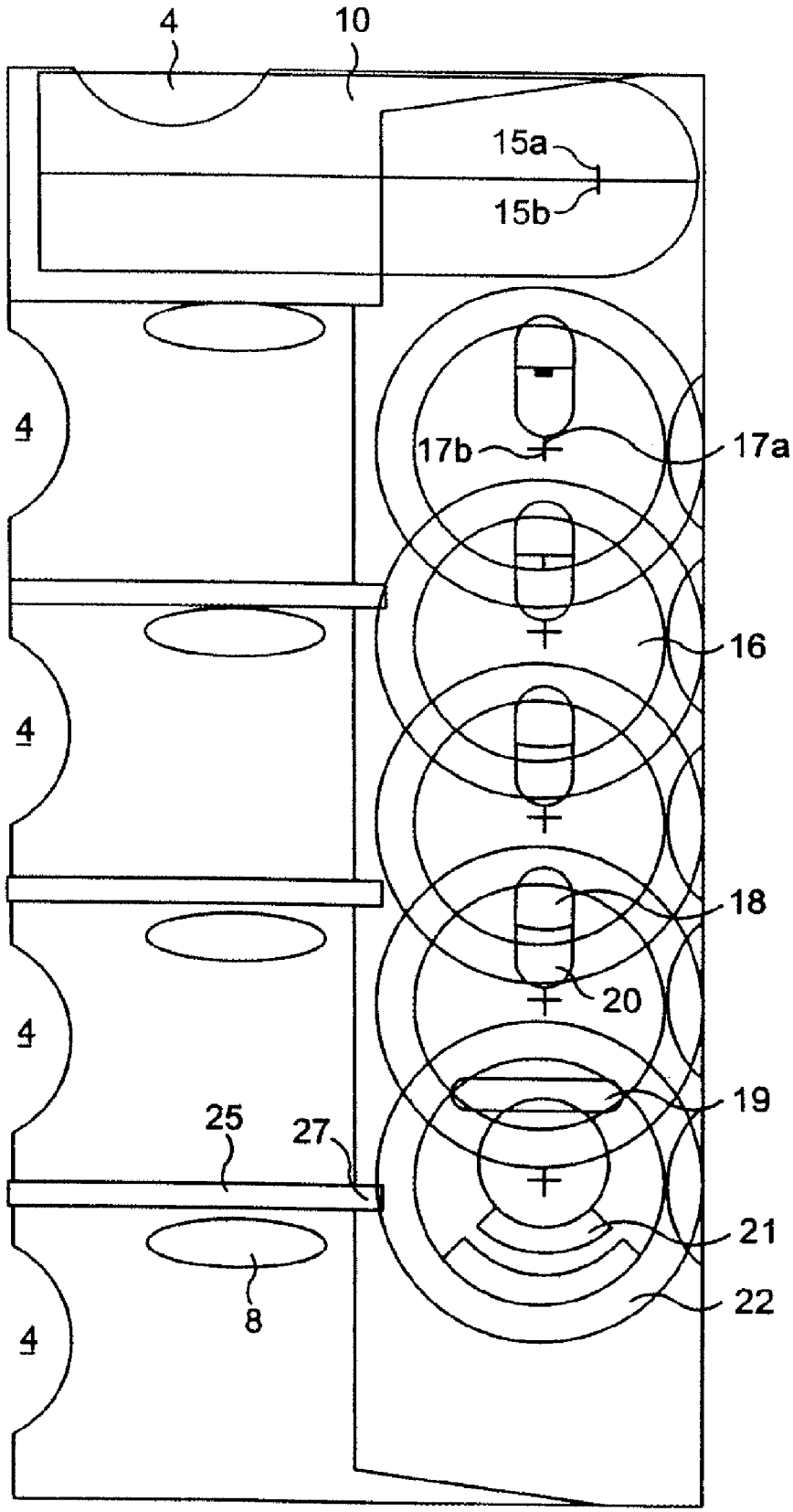
FIG. 8 is a schematic view of the bookmark when partially assembled.

As shown in FIG. 1 wheels 16*a*, 16*b*, 16*c*, 16*d* and 16*e* protrude from the left hand side of the bookmark from between the covers 1, 2. The wheels rotate on spindles 17*a* attached to the main covers 1, 2 as shown in FIGS. 7 and 8. Messages are printed on the wheels to be displayed in windows 18 and 19. The main purpose of the wheels in this example is to provide the user with a way of recording the last read page. In this embodiment the numbers 0 to 9 are printed on the front side of the wheel 16*a*, 16*b*, 16*c* and 16*d*; the wheel can be rotated until an appropriate number is shown in the window 18. The four windows 18 in combination display a number corresponding to the page number of the last read page of the book in which the bookmark is inserted. The largest recordable page number in the embodiment shown is 9999. Clearly, the number of wheels and windows can be altered to suit the type of book that will contain the bookmark. Wheel 16*e* contains information about part of the page at which the reader stopped reading, the information being selected by rotating the wheel and displaying it in window 19. Examples of suitable information messages are top left, top right, bottom left, bottom right.

Windows 20, 21 and 22 show messages on the rear side of the wheels. By printing messages on the rear side of the wheel, the wheels can be used to display more information and advertisements. The information displayed at the windows will change as the wheels are rotated. The information on the wheels can be pre-selected to suit the target market. In one embodiment the windows 20 can display messages that comprise words used in the field associated with the subject matter of the book. Consequently, if the bookmark is supplied with a medical book, the wheels may be rotated to display a number of useful words in the field of medicine. Alternatively, the messages may comprise words or phrases that form part of an advertisement.

Windows 21 and 22 are used to show a conversion table between different units e.g. monetary units such as pounds (£) and dollars ($) or other units such as Centigrade and Fahrenheit. For a given number of pounds displayed in the top window 21, the corresponding number of dollars will be displayed in the bottom window 22. A currency conversion function is useful for use with a travel book.

FIG. 7 illustrates one embodiment of a blank from which the bookmark can be fabricated. The blank may be formed of substantially rigid cardboard or other suitable sheet material and consists of the front and the rear main cover portions 1, 2, that are brought together by folding along a fold line 23. The rear main cover 2 has re-entrant flap portions 24, 25, and 26 protruding from it. The wheels 16*a*, 16*b*, 16*c*, 16*d* and 16*e* are mounted on the spindles 17*a* and the ruler 10 is mounted on spindle 15*a*. The spindles can of course be replaced by a single moulding, or bosses can be formed from plastic sheet if this is used instead of cardboard for the blank. In this embodiment the wheels are manufactured from thin cardboard sheets and their peripheries overlap. The flap 24 is folded onto the rear main cover 2 along with the strips 25 and 26, trapping the wheels 16 and the ruler 10. The end of the strips 25 fit into the notches 27 of the flap 24 and form the plurality of sections that define the pockets 3, with their side edges defined by the strips 25. An adhesive is used to adhere the portions 24, 25 and 26 to the front main cover 1.

Figure 9:
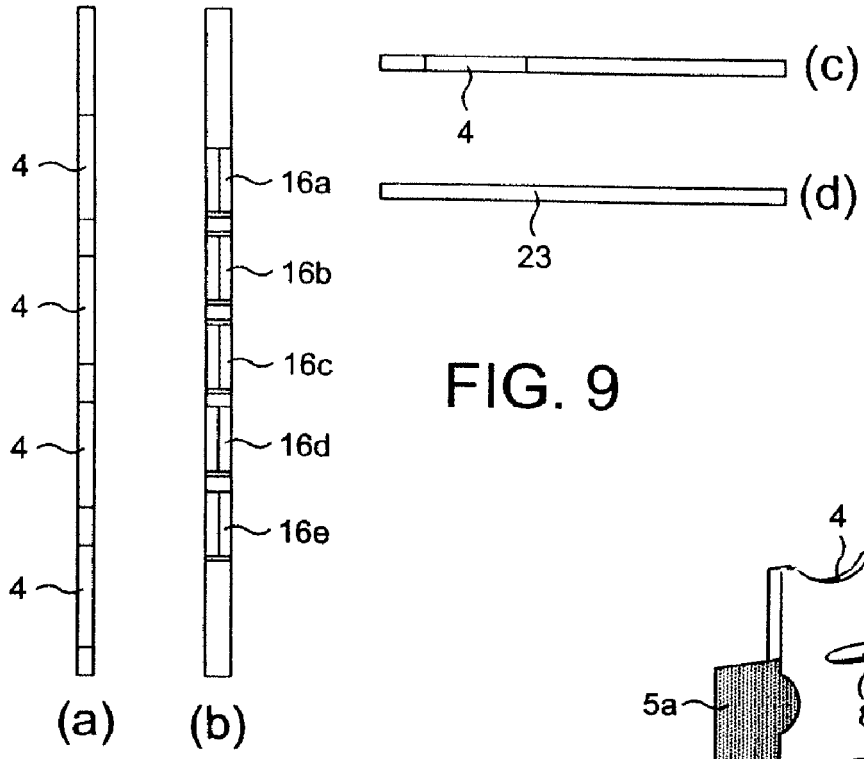
FIG. 9*a* is a view of the bookmark from the right hand edge.
FIG. 9*b* is a view of the bookmark from the left hand edge.
FIG. 9*c* is a top edge view of the bookmark.
FIG. 9*d* is a bottom edge view of the bookmark.

FIG. 9*b* is a view of the right hand edge of the bookmark. The wheels 16*a*, 16*b*, 16*c*, 16*d* and 16*e* can be provided with peripheral serrations to allow better grip for the user. The wheels 16 can be made of plastics material.

Figure 10:
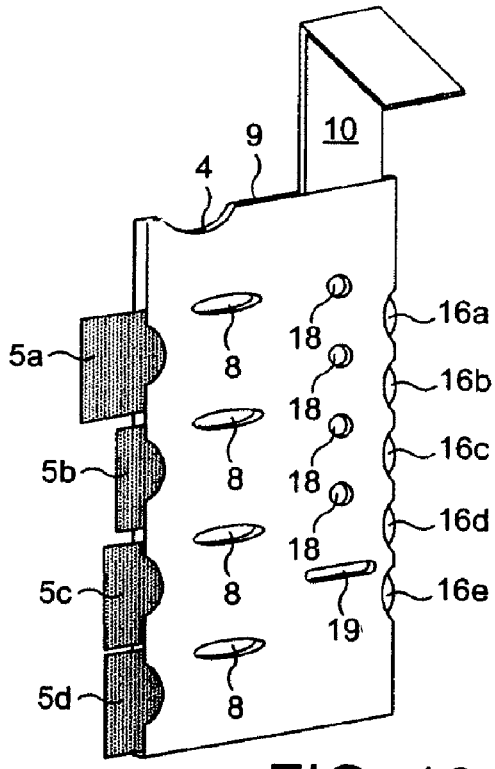
FIG. 10 is a perspective view of the bookmark showing the inserts partly extracted from the pockets.

The inserts 5 bearing advertising material are shown in FIG. 10 partly inserted in the pockets 3. It is also clear from FIG. 10 that the arm 10 can be folded in order to fit into the top pocket 9.

Figure 11:
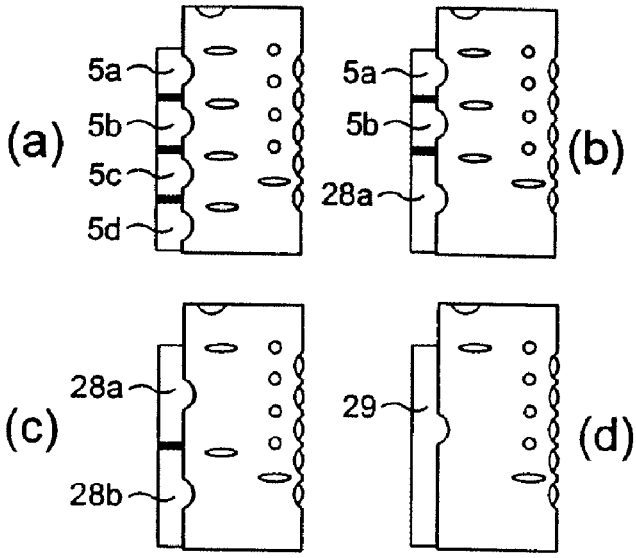
FIG. 11 illustrates four further different embodiments of the bookmark with different numbers of pockets, of different sizes.

FIG. 11 illustrates four different embodiments of the bookmark where the inserts 5 are of different sizes. The size of the pockets will be chosen depending on the size of the advertisement that needs to go into the pocket. FIG. 11*a* shows the same size of pockets as in FIGS. 1 and 2. The bookmark in FIG. 11*b* has three pockets containing advertisements, two small 5*a* and 5*d* and one medium sized 28*a*. FIG. 11*c* has two medium sized pockets 28*a* and 28*b* containing advertisements. FIG. 11*d* shows a bookmark with one large pocket for advertisements. Accordingly, the configuration of the blank in FIG. 7 can be varied to create differently sized and different numbers of pockets.

Figure 12A:
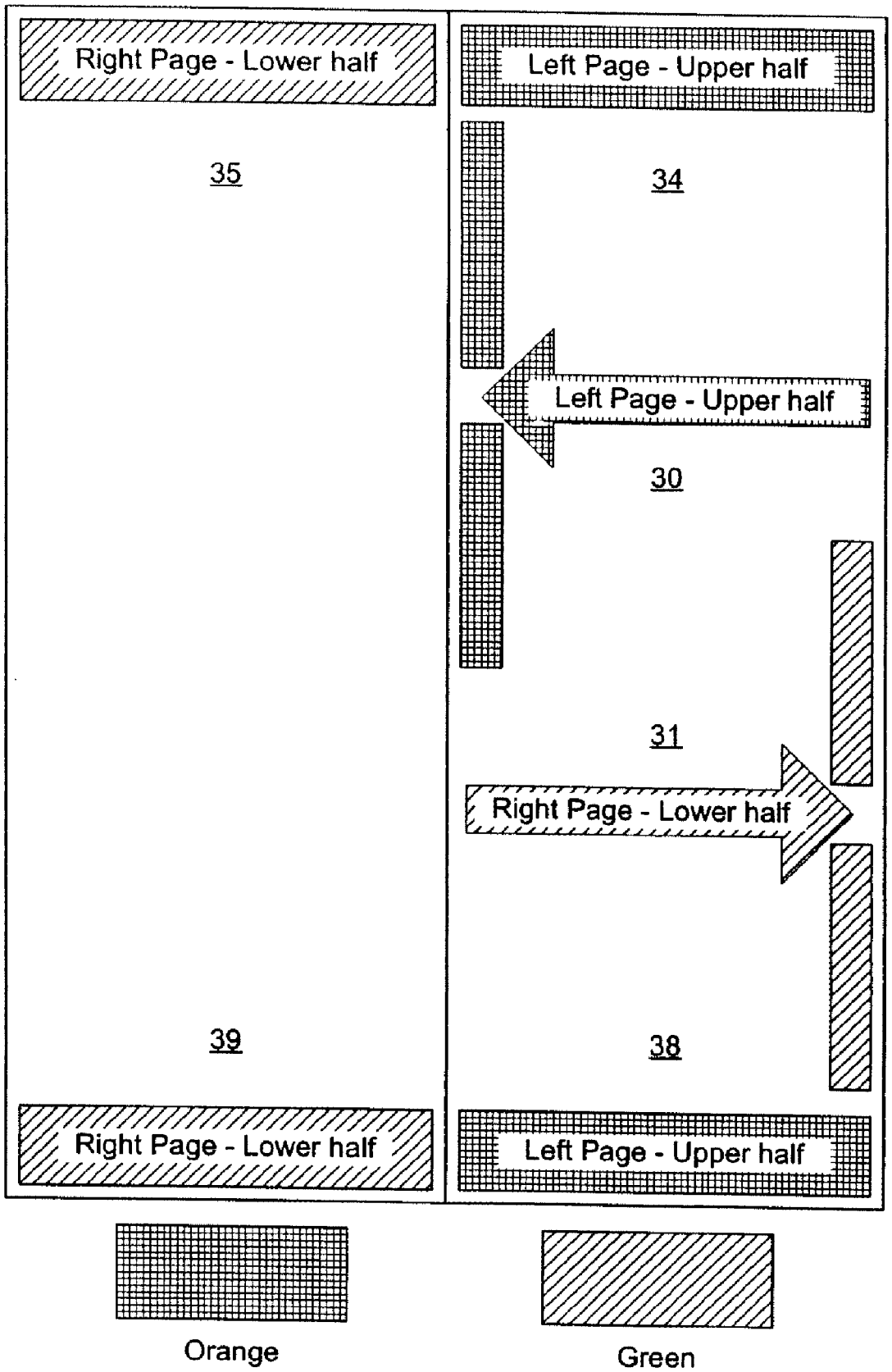
FIG. 12*a* illustrates a fifth embodiment of the bookmark from the front.
Figure 12B:
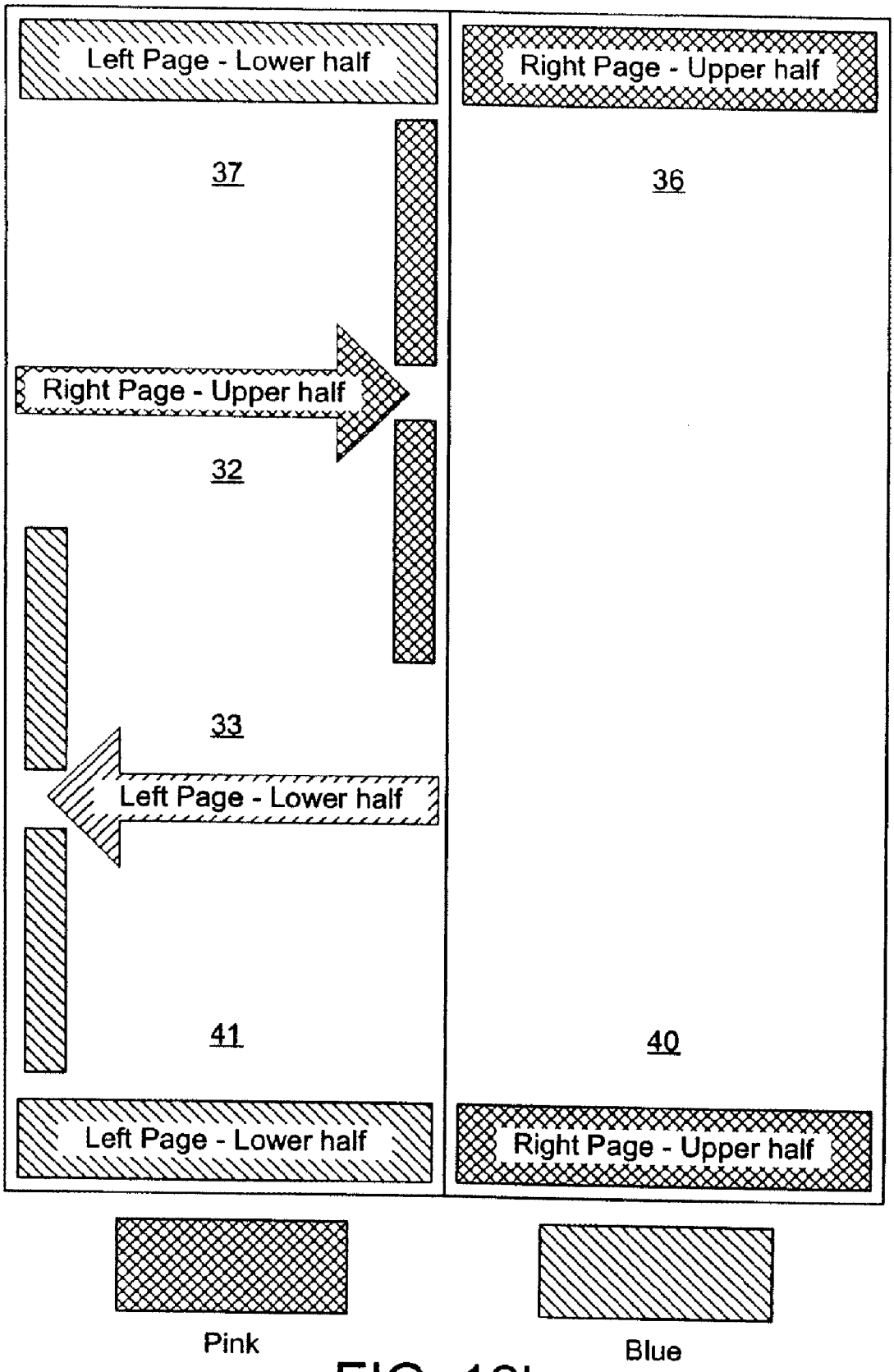
FIG. 12*b* illustrates the fifth embodiment of the bookmark from the rear.

FIG. 12 illustrates a further embodiment of the bookmark. FIGS. 12*a* and 12*b* illustrate its front and rear covers respectively. The front and rear faces of the bookmark contain advertisements or indicia relevant to the book (not shown). Four arrows in different colours are shown. The top and bottom of the bookmark have boxes coloured according to the colour of each arrows. Each arrow refers to a specific part of the spread of the book, namely, left page—upper half 30, right page—lower half 31, right page—upper half 32 and left page—lower half 33.

Figure 13:
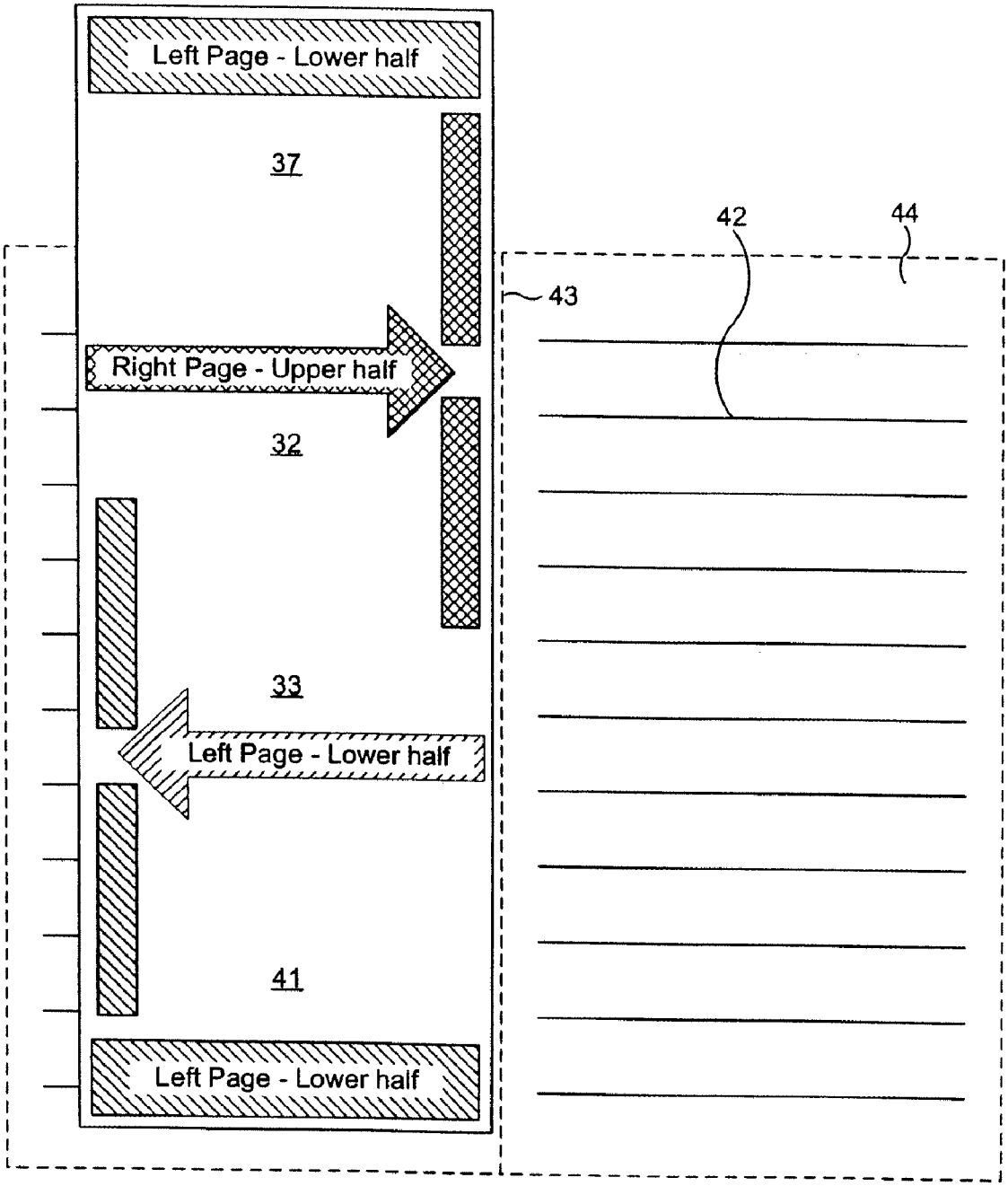
FIG. 13 illustrates how the bookmark shown in FIG. 12 is placed in a book.
Figure 14:
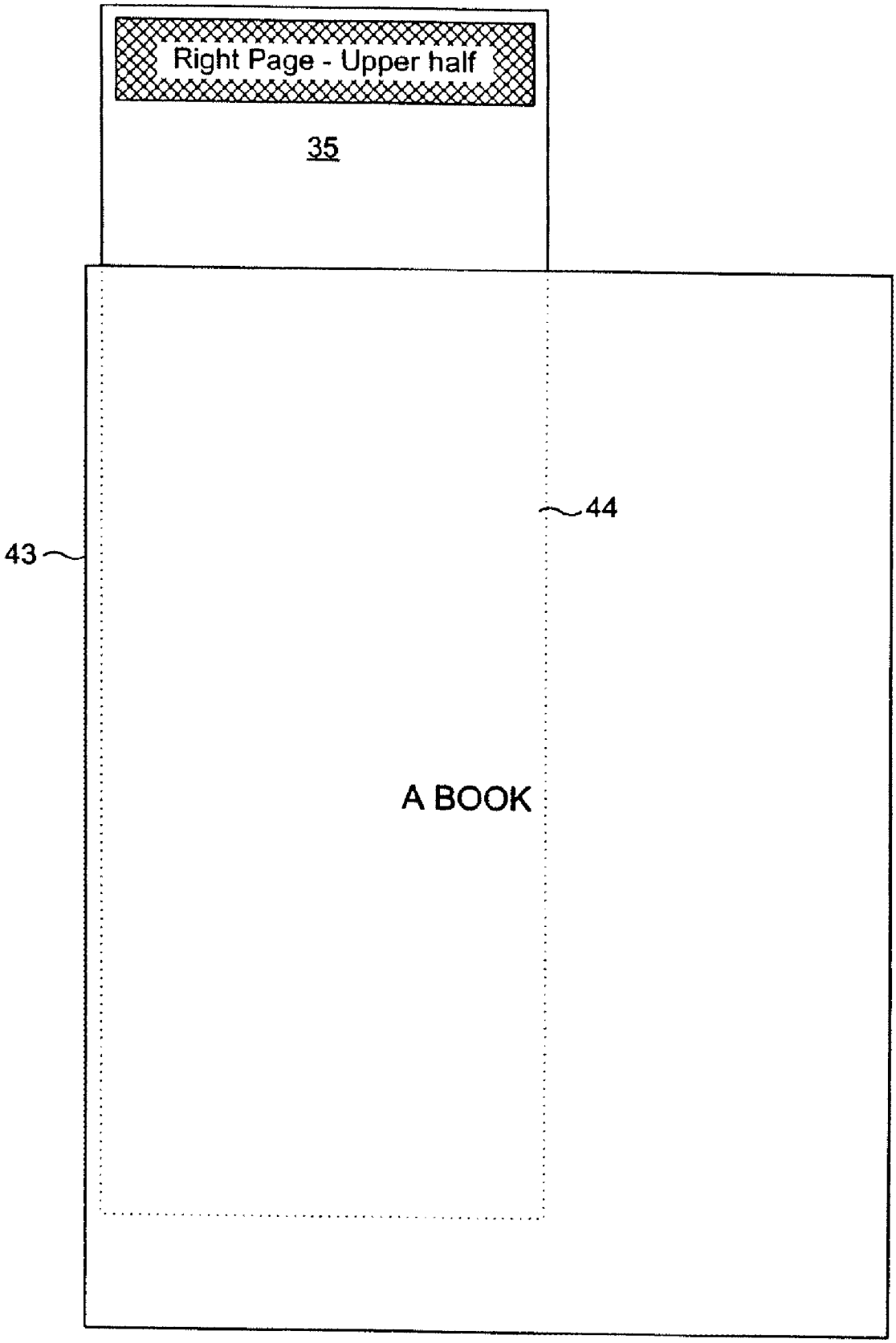
FIG. 14 illustrates the bookmark of FIG. 12 seen from the front of a closed book.

FIG. 13 illustrates how the bookmark is used. When the reader has finished reading he or she notes the last read line 42 and places the bookmark with the edge along the spine 43 of the book 44 and with the appropriate arrow pointing to the last line 42. When closing the book 44, one of the coloured boxes 34 to 41 will protrude at the top or the bottom of the book showing the colour corresponding to the appropriate arrow as shown in FIG. 14. In this example, the reader stopped reading at the top of the right hand page. Accordingly, the coloured box visible in FIG. 14 has the same colour as the arrow pointing to the last line 42. Consequently, even before the book is opened, the user knows at which part of the spread they finished reading, and when opening the book, reader will look at that part of the spread and search for the line to which the arrow points.

This embodiment of the bookmark can contain pockets as explained in the description above. The arrows on the face of the covers may replace at least some of the wheels and accordingly this embodiment provides more space for advertisements.

The described bookmarks may be used to distribute advertising and promotional material. Bookmarks as previously described with reference to FIGS. 1 to 14, bearing advertising and promotional material may be supplied free of charge to customers purchasing a book or other publication and a distribution scheme will now be described Referring to FIG. 15, a distribution organisation 45 comprises a distribution company i.e. a company incorporated according to the laws of an appropriate jurisdiction, with an issued share capital, the ownership of which will be described in more detail hereinafter.

The distribution company 45 enters into contracts 46, 47, 48 with publishers 49, 50 and 51 referred to hereinafter as publisher A, B and C respectively. The publishers may comprise publishing companies that, in a conventional manner, publish books or other publications in a number of different subject matter areas or categories, for example children's books, travel and gardening.

In their contracts with the distribution company 45, the publishers 49, 50, 51 agree to include bookmarks in their publications, supplied to them under the control of the distribution company 45. For example, if the books produced by the publisher are protected by a plastics shrink-wrapping, the bookmark is inserted within the book at the printing works of the publisher, underneath the shrink-wrapping. The publishers 49, 50, 51 supply copies of their publications including the bookmarks to retailers 52, 53 through their usual supply chains 54-58 for sale to customers. The bookmarks bearing advertising material are thus supplied free of charge to the customers at the point of sale by the retailers 52, 53.

Figure 15:
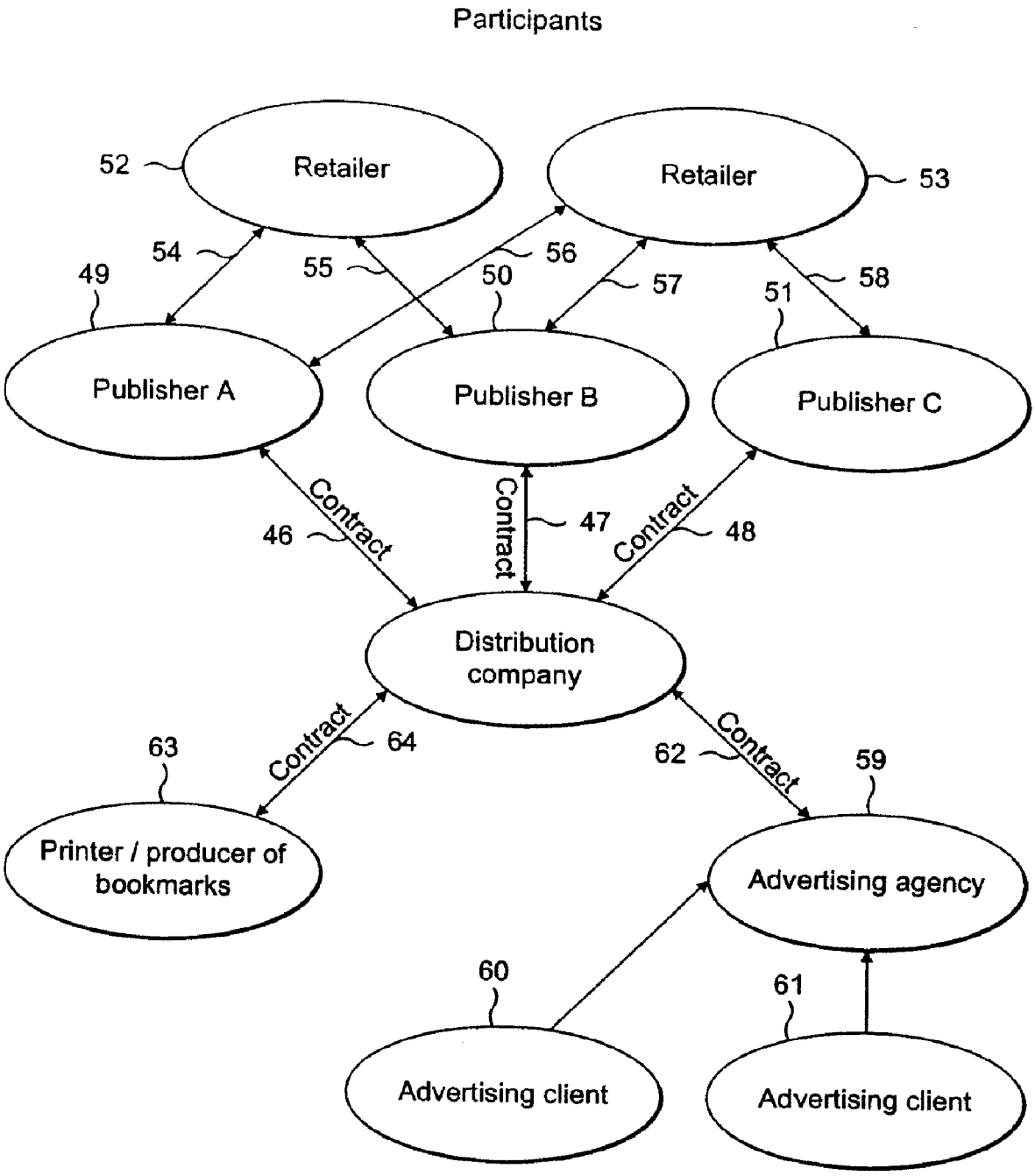
FIG. 15 is a schematic block diagram of participants in a method of distributing advertising and promotional material using bookmarks.

The distribution company 45 arranges the sale of advertising space on the bookmarks to advertising clients. In this example, the distribution company 45 makes use of the services of an advertising agency 59 which sells the advertising space although the distribution company 45 may alternatively or additionally have an in-house department to sell the advertising space. Two advertising clients 60, 61 are shown in FIG. 15 although in practice there may be many more. The commercial relationship between the distribution company 45 and the advertising agency 59 is defined in a contract 62 between them.

The manufacture and printing of the bookmarks in this example is contracted out by the distribution company 45 to a printing company 63 under a contract 64. The printing company 63 produces the bookmarks and advertising material according to the designs agreed by the distribution company 45, with advertising copy and other promotional material specified by the advertising agency 59 according to instructions received from the advertising clients 60, 61. The bookmarks are produced in different versions, one for each category of book, with printed matter and other details being configured to appeal to the readers of the particular category.

Figure 16:
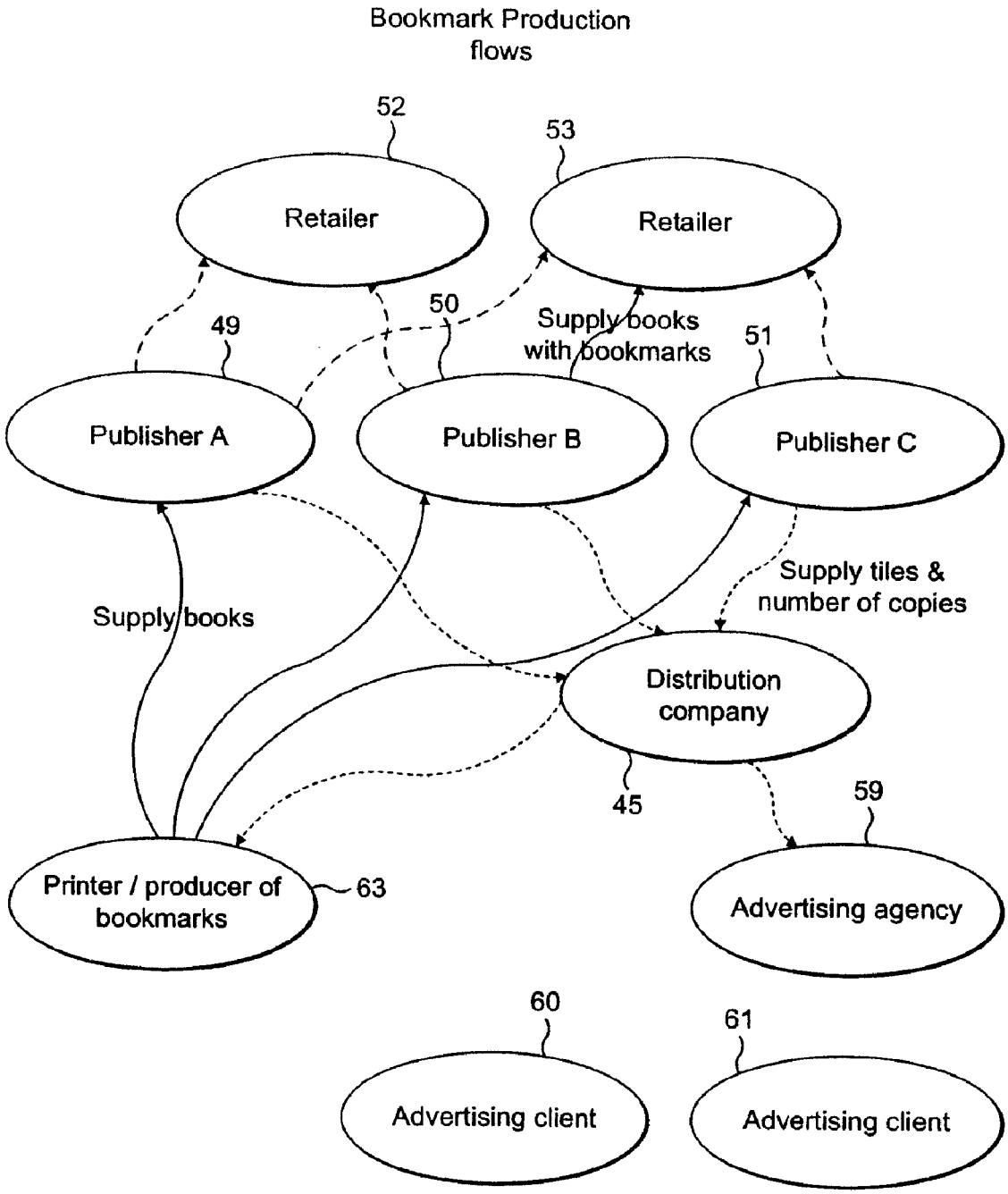
FIG. 16 is a schematic block diagram of production flows between the participants.

Referring to FIG. 16, the distribution company 45 coordinates a supply of bookmarks to the publishers 49, 50 and 51. The distribution company 45 receives information from the publishers 49, 50 and 51 concerning the titles of their publications that are to receive bookmarks and the print run for each title, namely the number of copies of the title that are to receive bookmarks. The different versions of the bookmarks are specifically designed to appeal to different categories of reader determined by the titles of the publications. An example is set out in Table 1 below in which the versions of the bookmarks are specifically designed for target reader groups in the following categories: travel, children, gardening, scientific and general. An example of data collated from the publishers is set out in Table 1 below, which shows the number of bookmarks of each category that the publishers contract to distribute with copies of their publications over a predetermined period e.g. 6 months, to continue in six monthly intervals for a 3 year period:

TABLE 1

| Category | Publisher A | Publisher B | Publisher C | Totals |
|---|---|---|---|---|
| Travel | 10,000 | 20,000 | 50,000 | 80,000 |
| Children | 30,000 | 40,000 | 15,000 | 85,000 |
| Gardening | 40,000 | — | 30,000 | 70,000 |
| Scientific | 5,000 | 60,000 | 20,000 | 85,000 |
| General | 50,000 | 20,000 | 5,000 | 75,000 |
| Totals: | 135,000 | 140,000 | 120,000 | 395,000 |

The distribution company 45 calculates from this data the number of bookmarks required for each category to be supplied to the publishers. This information is supplied to the bookmark printer 63 and the advertising agency 59.

The bookmark printer 63 produces the requisite number of bookmark versions for each category. For example, the bookmark may be configured as shown in FIGS. 1 and 2 and the same overall physical shape and configuration of the bookmark may be used for all of the five categories illustrated in Table 1. However, for each of the bookmark versions, the printing applied to the covers 1, 2 and the other previously described features of the bookmark are specifically designed and printed to appeal to readers of titles falling within the five individual categories shown in Table 1. Moreover, the inserts 5 received in pockets 3 will contain advertising or other promotional material specifically directed to the five individual categories and the copy or designs for the inserts are supplied to the printer by the advertising agency 63 as explained in more detail below. In this way, advertising space can be sold, specifically directed to particular target groups according to the categories of publication.

The advertising agency 59, sells advertising space for the five categories of bookmark set out in Table 1 to the advertising clients 60, 61. The creative departments of the advertising agency can develop advertising and promotional material for inclusion in the different categories of bookmark, specifically directed to target reader groups based on the categories set out in Table 1. Moreover, the pricing for the advertising copy can be determined based on the projected production runs for each category of bookmark set out in Table 1. The advertising space on the bookmarks may comprise the inserts 5 shown in FIGS. 1 and 2 or messages associated with the windows 20, 21 and 22. The advertising agency 59 supplies the copy to the distribution company 45, which then supplies it to the printer 63.

The printer 63 thus produces or obtains the inserts 5, places them in the appropriate versions of the bookmarks, and supplies them in appropriate numbers to the publishers 49, 50, 51 in accordance with the data set out in Table 1.

The publishers 49-51 include the appropriate versions of the bookmarks in the copies of their titles and supply them to the retailers 52, 53 for sale to customers. As previously mentioned, for books which are shrink-wrapped, the bookmark may be included within the shrink-wrapping. Alternatively, the bookmarks may be inserted within the pages of books without shrink-wrapping. The bookmarks may also be supplied separately from the books and inserted into them at the point of sale.

Figure 17:
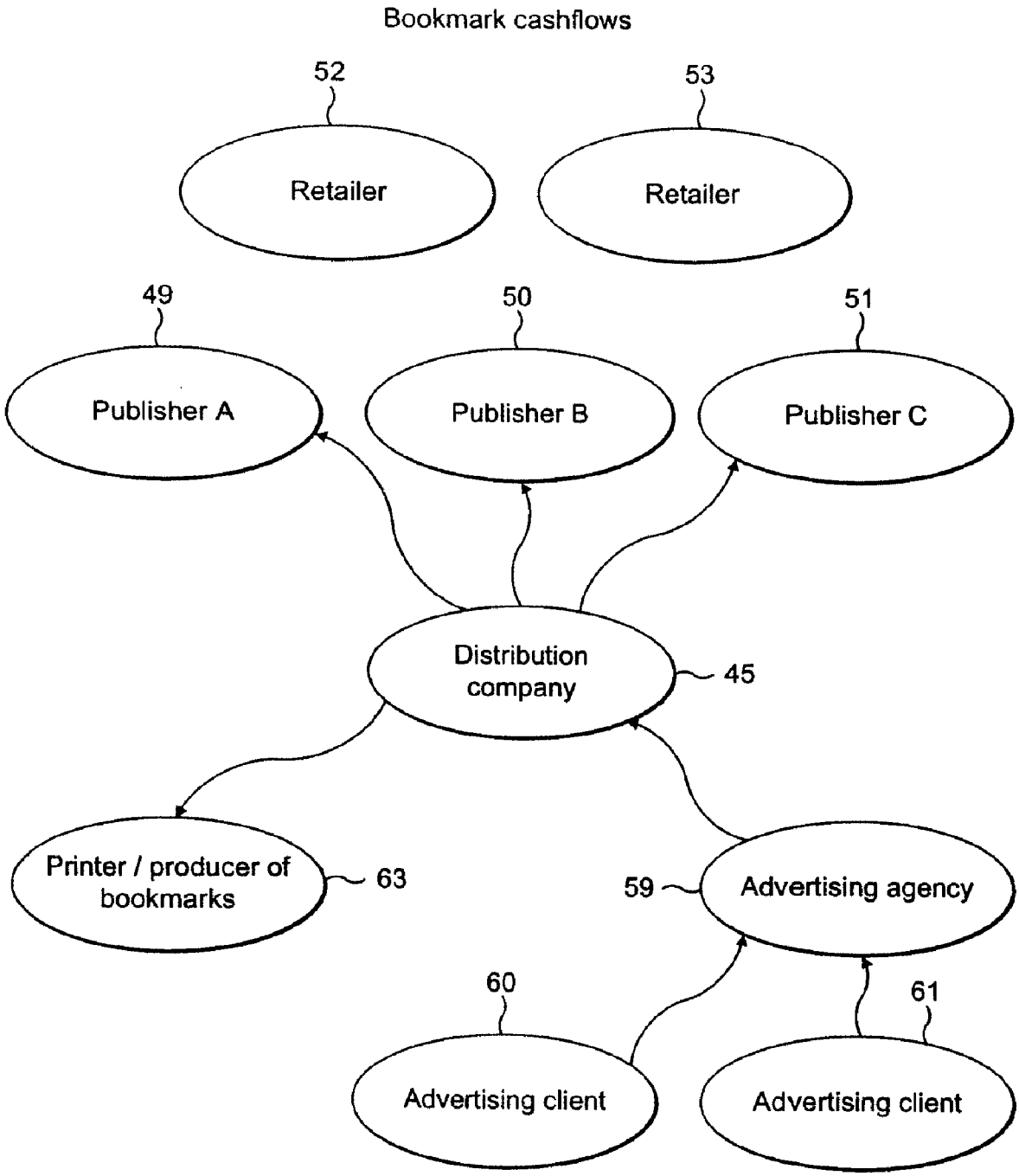
FIG. 17 is a schematic illustration of the cash flow associated with distribution of the bookmarks.

FIG. 17 illustrates the cash flows associated with the distribution of bookmarks. The advertising clients 60, 61 pay for the advertising space that they purchase and in this example, the payments are made to the advertising agency 59. The advertising agency 59 deducts its expenses according to an agreed formula specified in its contract 62 with the distribution company 45 and pays the remainder of the income from the advertising clients to the distribution company 45.

The distribution company 45 makes payments to the printer 63 and the publishers 49-51. The printer 63 is paid according to the contract 64 (FIG. 15) which may specify a price per bookmark, although other contractual arrangements will be evident to those skilled in the art.

There are two modes of payment made by the distribution company 45 to the publishers 49-51. The first payment mode comprises payments calculated on the basis of the number of bookmarks supplied to individual publishers e.g. n cents per bookmark so that in the example of Table 1, publisher A would receive 135,000×n cents for the bookmarks supplied to it. This payment is relatively small and is intended to compensate the publisher for the additional work carried out to insert the bookmarks into the copies of the books and distribute them to the retailers.

Figure 18:
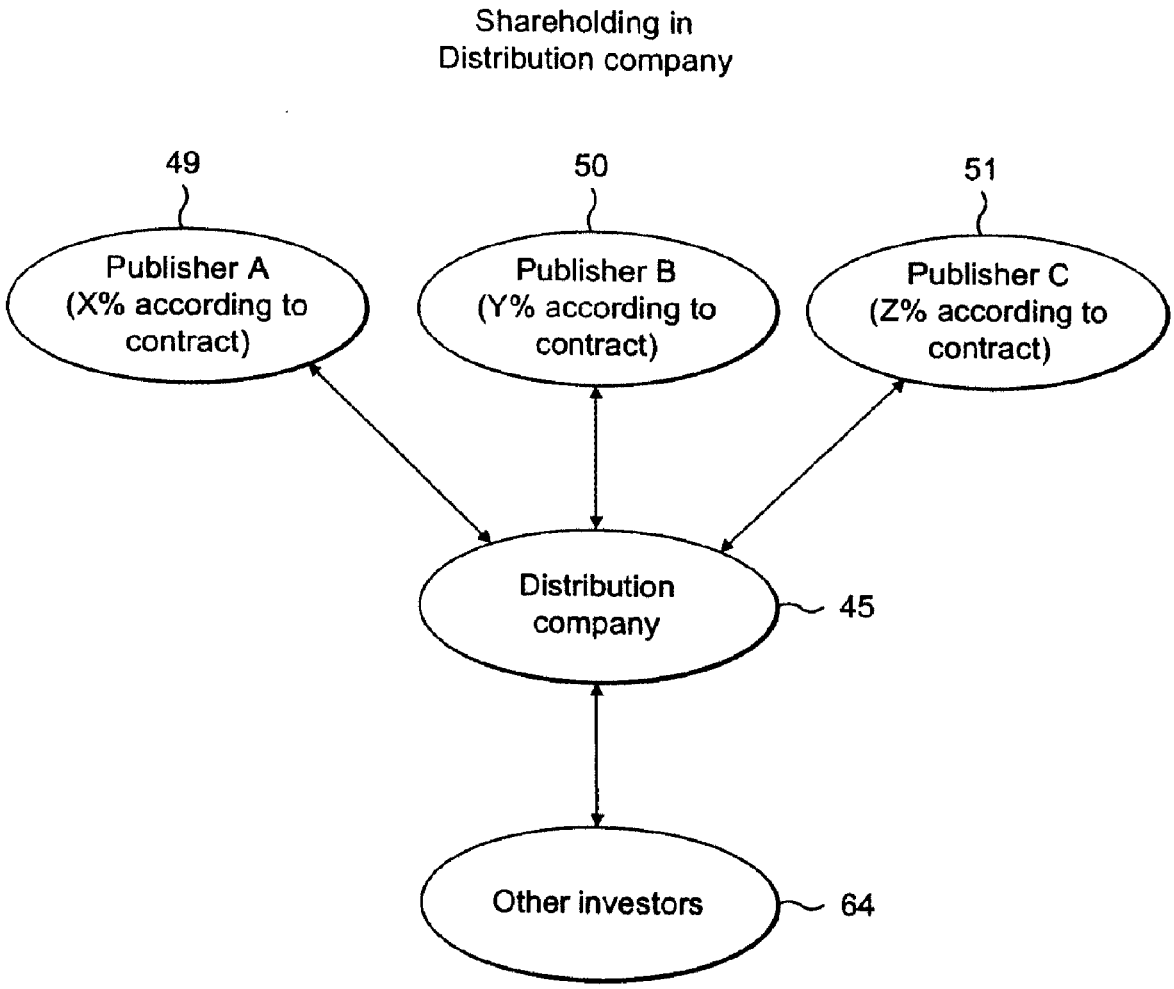
FIG. 18 is a schematic illustration of the shareholding in a distribution company that organises distribution of the bookmarks.

Also, the publishers are made shareholders of the distribution company 45 and they receive a share dividend dependent upon the profitability of the distribution company 45. The shareholdings of the individual publishers 49, 50, 51 are determined by the number of copies of their publications that they offer to the distribution company 45 to receive bookmarks. As previously mentioned, the publishers 49, 50, 51 enter into contracts 46, 47, 48 shown in FIG. 15 which specify the number of copies that they undertake to be provided with bookmarks and their shareholdings are determined in accordance with these contractual undertakings. The arrangement of the shareholdings is illustrated schematically in FIG. 18. The issued shares of the distribution company 45 are held by the publishers 49, 50, 51 together with other investors 64. In one non-limiting example, the other investor 64 holds 75% of the shares and the remaining 25% is distributed amongst publishers A, B and C. The individual publishers hold shareholdings X %, Y % and Z % of the remaining 25% of the shares in the distribution company 45 where the values of X, Y and Z are determined as a function of the relative numbers of bookmarks they undertake to include in their publications in their contracts 46-48 with the distribution company 45. In this way, the potential dividend payable to the publishers individually depends on the level at which they engage with the supply of bookmarks in their publications. This arrangement encourages the publishers to distribute the bookmarks.

The arrangement is very attractive to advertisers because the different versions of the bookmark each provide an advertising vehicle tailored to a particular customer group, namely the readers of a particular category of book and so the advertising copy can be particularly focused towards them.

Many modifications and variations to the described distribution method will be readily apparent. For example, whilst the distribution organisation has been described as a corporate body it could be organised in different ways for example a partnership, limited liability partnership or sole trader. Also, more or less than three publishers can be contracted.

Figure 19:
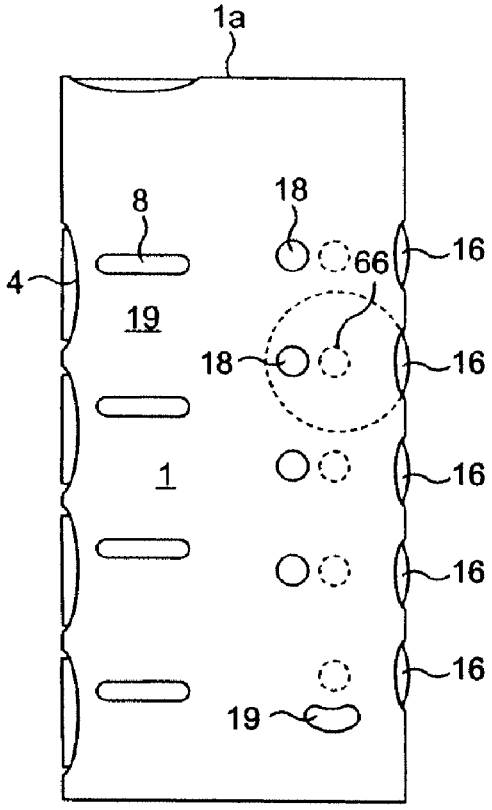
FIG. 19 is a front view of a sixth embodiment of a device according to the invention which may be used as a bookmark or for promotional purposes.
Figure 20:
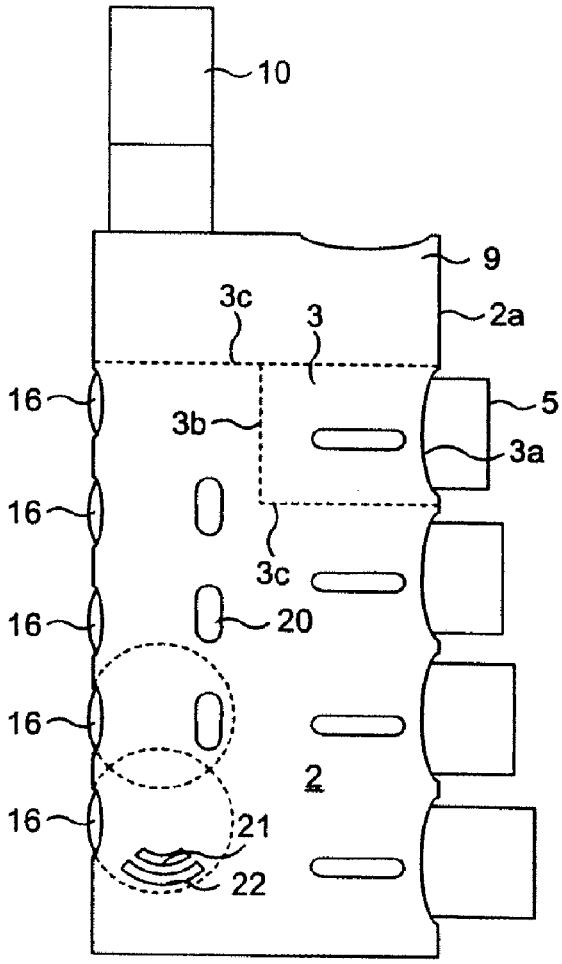
FIG. 20 is a rear view of the device of FIG. 1.

Another embodiment of device according to the invention which may be used as a promotional device or a bookmark is shown in FIGS. 19 and 20. Like parts to those of FIGS. 1 and 2 are given the same reference numbers. The device comprises a front main cover 1 and a rear main cover 2 that are generally coextensive and overlie one another. In this embodiment, the front and rear main covers 1, 2 are rectangular, made of sheet material such as cardboard and have generally the same size and shape. The front and rear covers 1, 2 have outer faces that display text and images (not shown) that are appropriate for the book that will contain the bookmark in the manner previously described with reference to FIGS. 1 and 2.

The bookmark further comprises a number of sections that act as pockets 3 between the front and rear main covers 1, 2, the pockets 3 having openings disposed along the left hand longitudinal perimeter edges 1*a*, 2*a* of the covers 1, 2 as shown in FIG. 20. Each pocket has an opening 3*a* at the perimeter edges 1*a*, 2*a* of the covers 1, 2. A recess 4 at the opening 3*a* of each pocket facilitates access to the contents of the pockets. Each pocket 3 has a rear 3*b* opposite the opening 3*a* and side edge regions 3*c* between the covers 1,2 as shown in dotted outline for one of the pockets. The pockets 3 contain inserts 5 that bear advertisements and/or provide promotional material directed to target reader groups as previously described to FIGS. 1 and 2. The advertisements may comprise printed matter and any of the examples previously described with reference to FIG. 4 may be employed.

Figure 21:
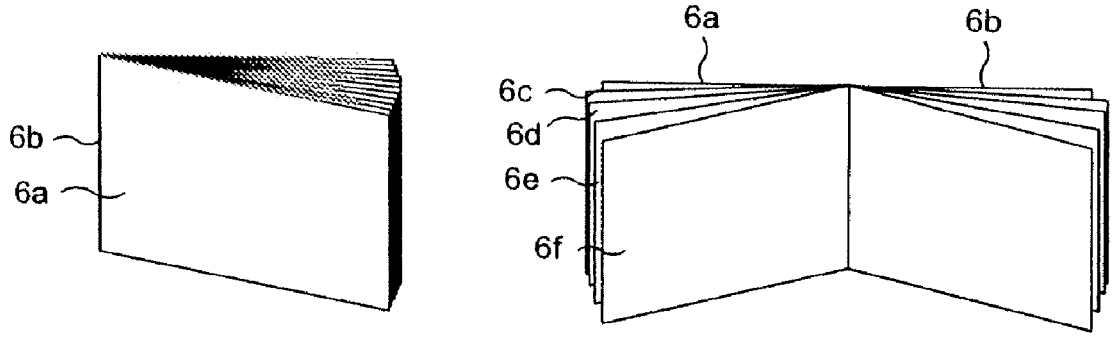
FIG. 21 shows an open and closed insert respectively.

One further embodiment of an insert 5 is shown in FIG. 21 by way of example. The insert may be made from a rectangular sheet of card that is cut and folded to create a booklet having a front and a back cover 6*a*, 6*b* and a number of pages 6*c*, 6*d* etc. The insert 5 is of generally the same size and shape as the pocket 3 in the bookmark. Indicia can be printed on both sides of the insert covers 6*a*, 6*b* and on the pages 6*c*, 6*d* etc.

The front main cover 1 of the bookmark includes windows 8 which allow the reader to preview the contents of the pockets, and the contents themselves may be configured to have a legend or similar display to be aligned with a corresponding window, as previously described with reference to FIGS. 1 and 2.

As shown in FIGS. 19 and 20, the device may also have a top pocket 9 to receive an implement or other item that is attractive or useful for the reader, such as an extendable ruler 10 or an extendable arm made e.g. of cardboard, provided with a book light, driven by a thin battery (not shown) between the front and rear covers 1, 2.

The device shown in FIGS. 19 and 20 has wheels 16 which function generally in the same way as those described with reference to FIGS. 1 and 2. Indicia are provided on one side of the wheels for display through windows 18 and 19 in the front cover 1. When the device is used as a bookmark, the wheels 16 may be used to provide the user with a way of recording the last read page. The numbers 0 to 9 may be printed on the front side of each of the wheels 16 and the wheels can be rotated until the number of the last read page of the book is shown in the windows 13. The wheel 16*e* contains information about the part of the last page at which the reader stopped reading, for display by rotating the wheel until an appropriate message is displayed in the window 19. Additional information can be provided on the rear side of the wheels 11 to be displayed in various windows 20 in the back cover 2 of the bookmark.

Figure 22:
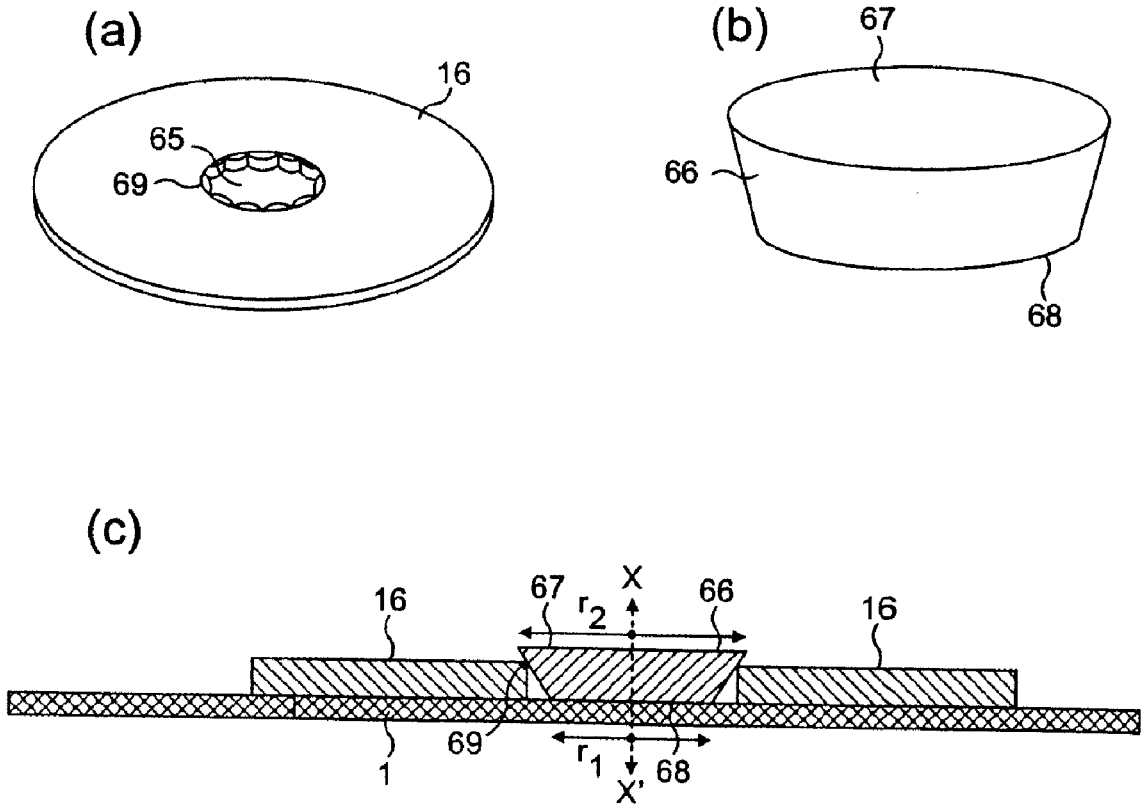
FIG. 22*a* shows a wheel of the rotary wheel assembly in the device of FIG. 19.
FIG. 22*b* shows a stub axle of the rotary wheel assembly.
FIG. 22*c* is a sectional view of the assembly taken along line A-A' in FIG. 23

FIGS. 22*a* and 22*b* illustrate components for the assembly of each wheel 16 according to one embodiment of the invention. One of the wheels 16 is shown in FIG. 22*a* and is generally disc shaped with a centrally located, axial opening 65 that receives the stub axle 66 shown in FIG. 22*b* and has a conical shape such that the diameter of end surface 67 is larger than the diameter of end surface 68. As shown in FIG. 22*c*, the end surface 68 is attached to the interior surface of the front cover 1, which acts as a substrate over which the wheel 16 rotates. The stub axle 66 is upstanding from the substrate provided by cover 1 and provides an axis of rotation X-X' for the wheel 16. The end surface 68 proximal to the cover 1 has a radius $r_1$ which is less than the radius of distal end surface $r_2$. The effective radius of the axial opening 65 in the wheel 16 is slightly greater than the radius $r_1$ of the proximal end surface 67 of the stub axle and less than the radius $r_2$ of the distal end surface 68.

The wheel assembly is fabricated by attaching the stub axle 66 to the substrate 1, e.g. by gluing, and then push-fitting the wheel 16 onto the stub axle 66 such that the wheel 16 can be rotated about the axis X-X' provided by the stub axle, over the substrate 1. The radii of the proximal and distal ends of the stub axle 66 together with the radius of the axial opening 65 and the resilience of the materials of the stub axle 66 and the wheel 16, are so configured that when the wheel 16 is push-fitted onto the stub axle, the wheel 16 is resiliently deformed around its opening 65 to pass over the distal end 67 of the stub axle and become captured on the stub axle such that the wheel 16 can rotate about the axis X-X'.

Both the wheel 16 and the stub axle 66 may be made of cardboard or any other rigid sheet material such as plastic, paper or fibreboard. In an alternative embodiment the stub axles 66 and the cover 1 may be manufactured as a single item by moulding.

The opening 65 in the wheel 16 may be serrated on its inner periphery 69 in order to facilitate the resilient deformation when push-fitted onto the stub axle 66 and also to allow a firmer grip onto the stub axle. Thus the wheel 16 can be manually rotated but is frictionally engaged with the stub axle to prevent free rotation. Thus a user can rotate the wheels 16 to align the indicia on the wheels with the windows 18, which thereafter will remain in the set position and will not spuriously move out of alignment. The length of the stub axle 66 in the axial direction X-X' is equal to or greater than the thickness of the wheel 16 in the axial direction so that the wheel can rotate without producing significant frictional forces on the surface of the cover 1, as will be more evident hereinafter.

In the embodiment shown in FIG. 22*a* the inner periphery 69 of the opening 65 is in the form of a regular polygon. This shape results in there being a maximum diameter and a minimum diameter of the opening 65 wherein the maximum diameter is substantially equal to the diameter of distal end region 67 of stub axle 66 and the minimum diameter is substantially equal to the diameter of the proximal end region 68 of the rotary wheel assembly. Typical dimensional values are a diameter of the distal end region 67 of the stub axle of 8.00 mm and a diameter of the proximal end 68 of 7.8 mm. The outer diameter of the wheel 16 may be 32 mm and the average diameter of the serrated opening 69 may be 7.9 mm. A typical thickness of the stub axle in the axial direction X-X' is 1.00 mm and a typical thickness of the wheel in the axial direction is 0.34 mm. In one embodiment, the polygonal opening 69 presents a maximum and minimum radial dimension on the axis X-X', the minimum dimension being smaller than the radial dimension of the distal end 67 of the stub axle and the maximum dimension being greater than the radial dimension of the proximal end 68 of the stub axle 66.

Figure 23:
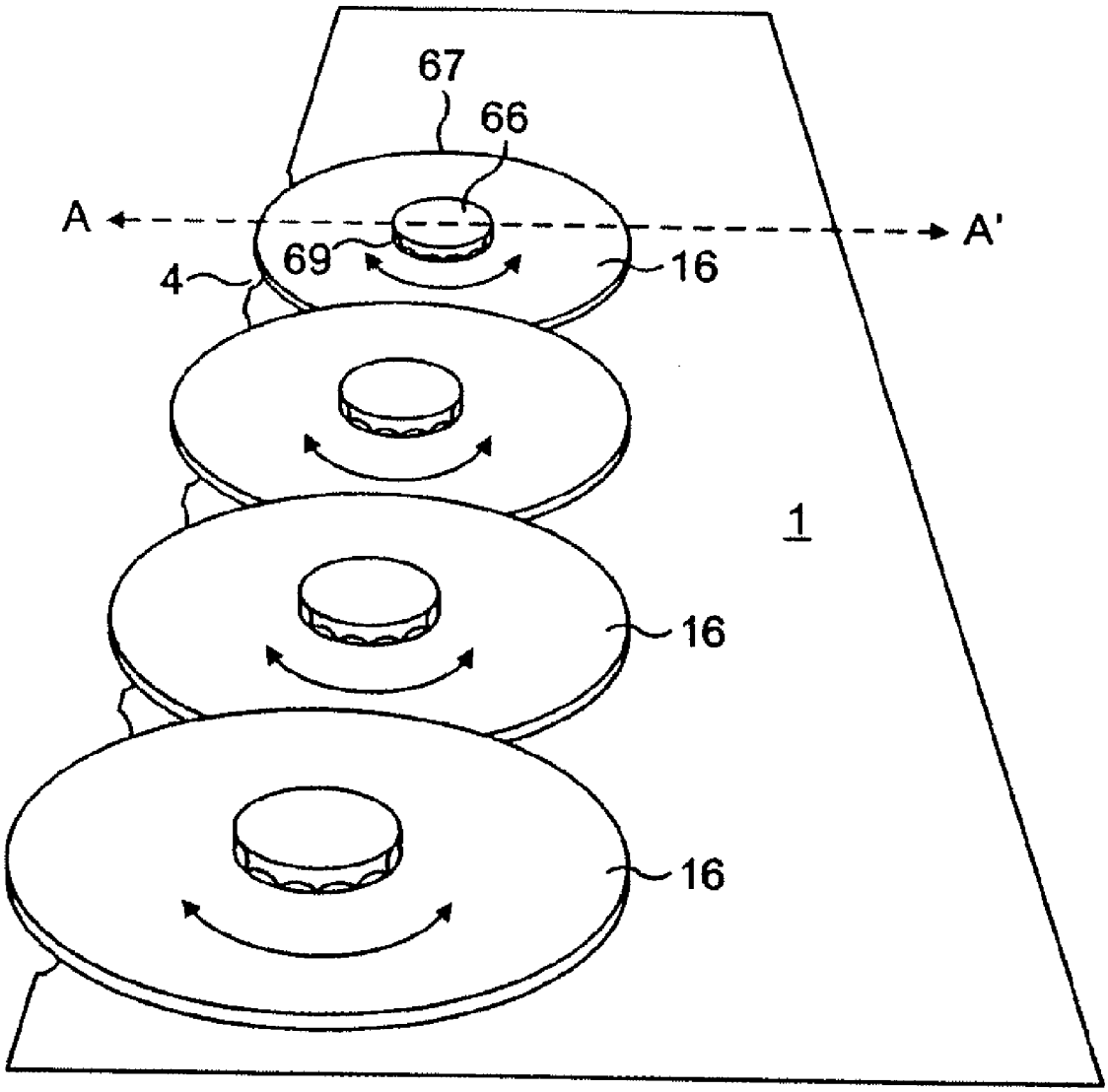
FIG. 23 is a perspective view of the wheels when mounted in the device.

FIG. 23 illustrates schematically four wheels 16 mounted on respective stub axles 66 on the front main cover 1. All the stub axles 66 are glued to the cover 1 and the wheels 16 have been push-fitted onto the stub axles 66. Recesses 4 permit the wheels 16 to be rotated from the side of the bookmark. From FIG. 23 it can be seen that the wheels 16 are thin enough to overlap one another.

Figure 24:
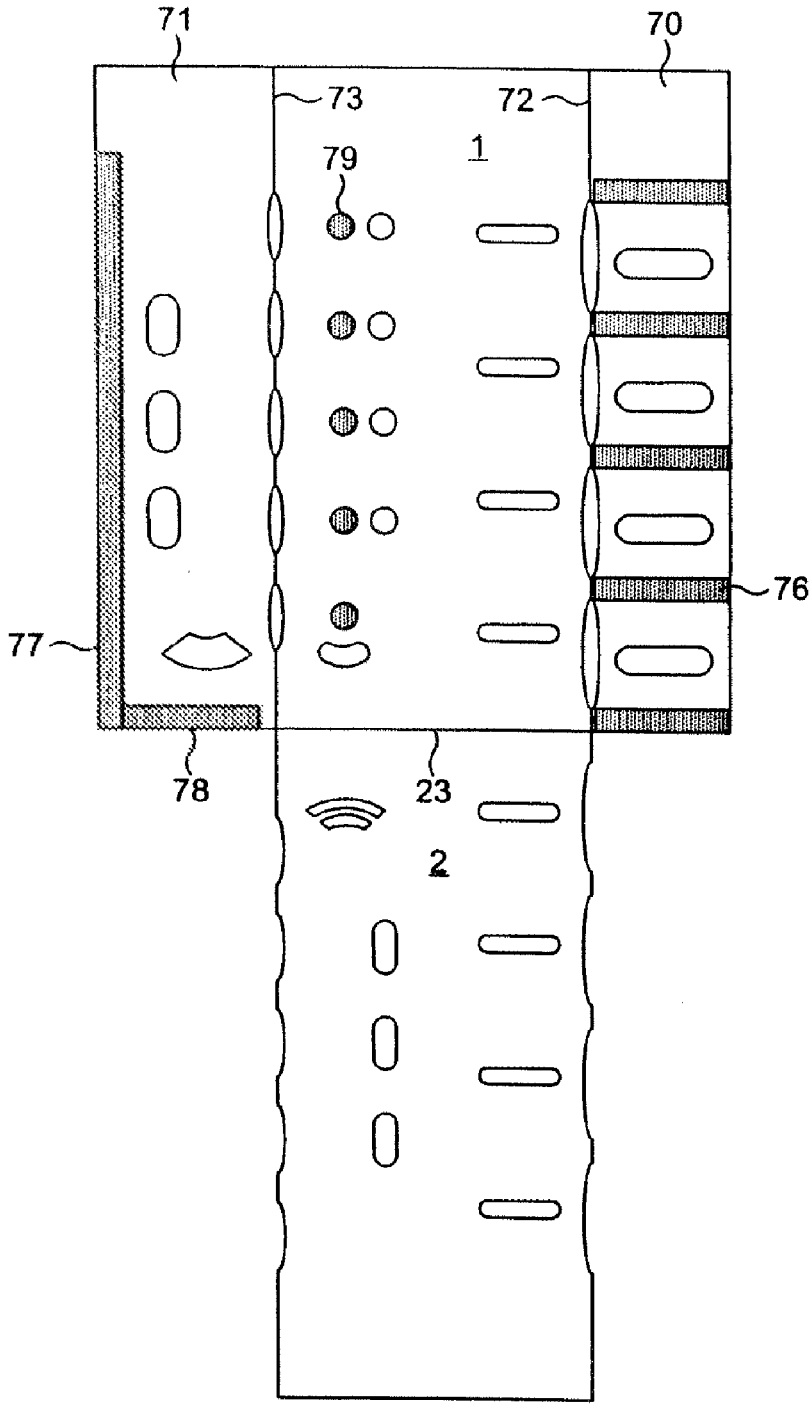
FIG. 24 shows a blank for a bookmark corresponding to FIGS. 1 and 2.

FIG. 24 illustrates one embodiment of a blank from which the bookmark can be assembled. The blank can be made from cardboard or another suitable sheet material, for example by stamping. The blank shown in FIG. 24 does not have a section 9 for a ruler or book light 10, but the blank can easily be adapted if a top pocket 9 is required. The blank can be printed and cut prior to the assembly.

Figure 25:
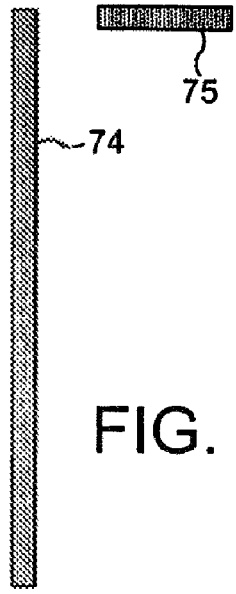
FIG. 25 shows guiding strips to be attached to the blank of FIG. 24.

The blank consists of the front and rear main covers 1, 2 coupled along a fold line 23. The front main cover 1 has first and second re-entrant portions 70 and 71 protruding there-from, and foldable along fold lines 72, 73. Guiding strips and blocking strips 74, 75, as shown in FIG. 25, are provided to define the edges of the pockets. An adhesive is applied to regions 76 of the first re-entrant portion 70 and guiding strips 75 are positioned on regions 76 respectively to define the sides of the pockets 3. Similarly, an adhesive is applied to region 77 of re-entrant portion 71 and the blocking strip 74 is positioned in region 77 to define the rear 3*b* of the pockets when the bookmark is assembled. A further blocking strip 75 may be attached to region 78.

Figure 26:
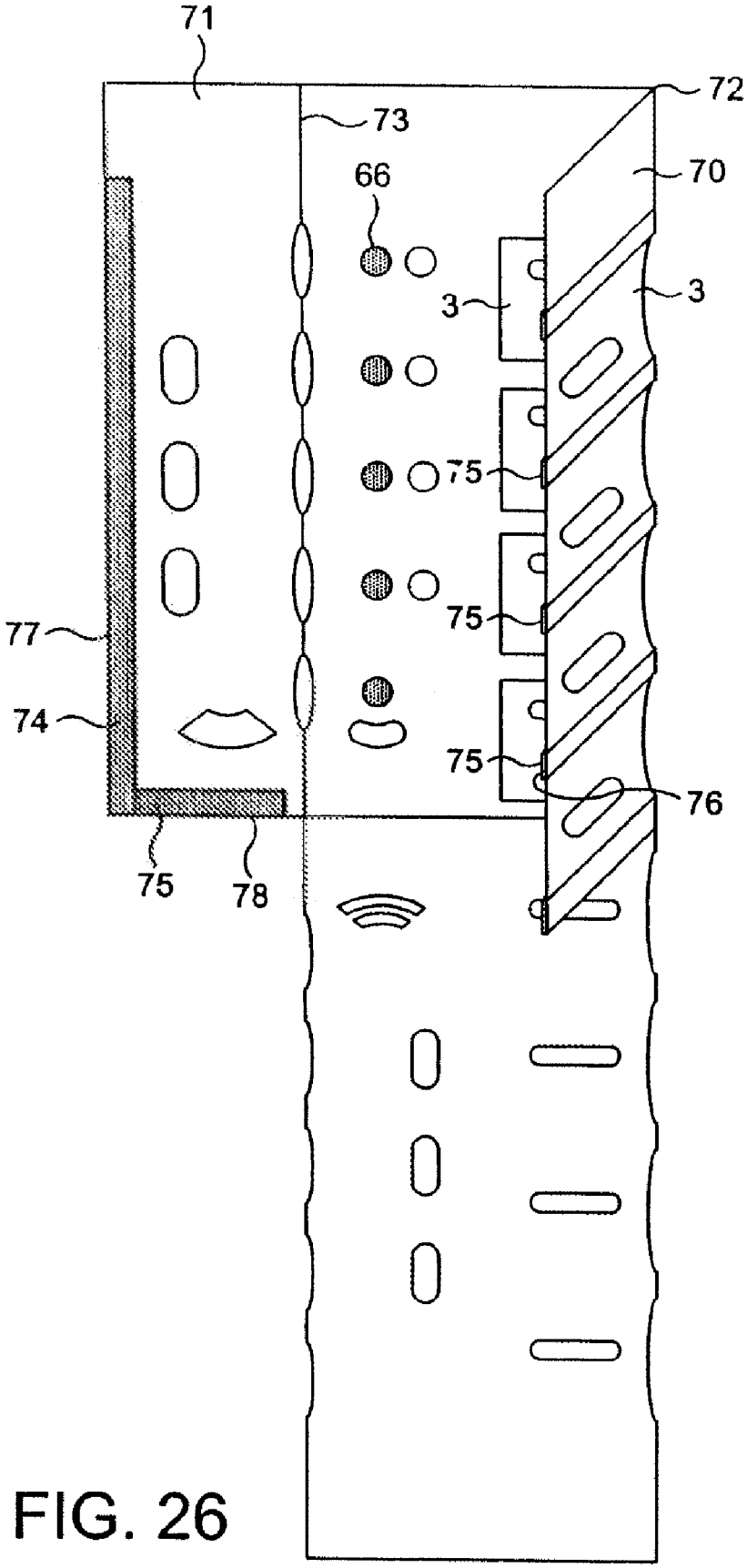
FIG. 26 illustrates how the blank of FIG. 25 is folded to form pockets.

Additionally, stub axles 66 are attached using an adhesive to regions 79 of the inside of the front main cover 1. The next step is to apply adhesive to the exposed surfaces of the guiding strips 75 in regions 76 and to fold the first re-entrant portion 70 along fold line 72 towards the main front cover 1 in order to form the pockets. FIG. 26 shows the blank when the blocking strips, guiding strips and inner wheels have been attached. Moreover, the first re-entrant portion 70 is partly folded along line 72 towards the front main cover 1. The guiding strips 76 will then adhere to the interior surface of the cover 1 of the blank for defining the pockets 3 in the bookmark.

Figure 27:
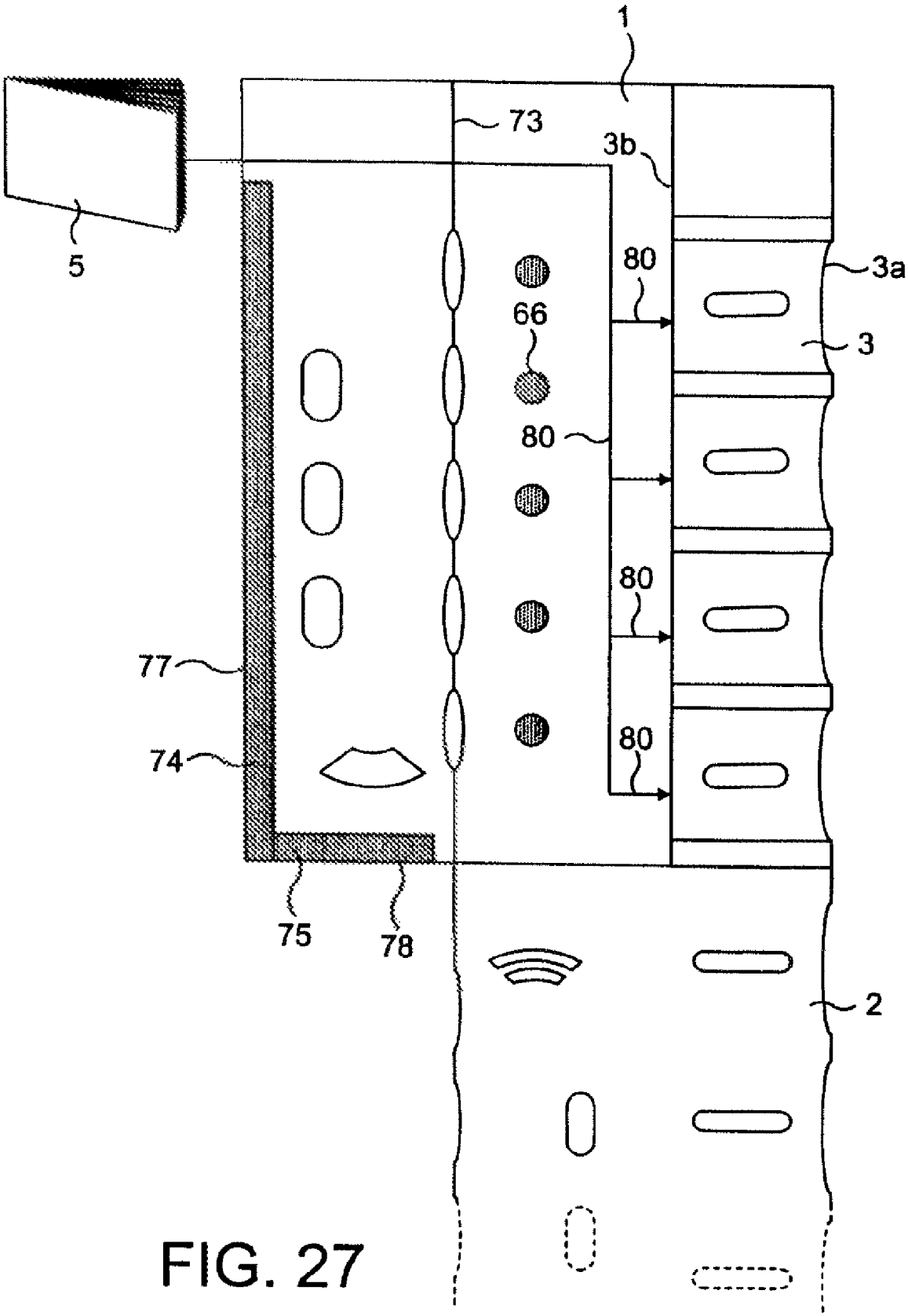
FIG. 27 illustrates a method by which the inserts are inserted into the pockets.

FIG. 27 illustrates the method of placing the inserts 5 into the pockets 3. The method comprises advancing the inserts into the pockets from the rear 3*b* of the pockets, as shown by arrows 80, rather than through the openings 3*a*. This ensures a quicker assembly than if the pockets were inserted through the openings 3*a* because the main front cover 1 can be used as a guiding surface when the inserts 5 are inserted from the rear, without having to position the inserts accurately between the front and rear covers 1,2 as would be required when attempting to place the insert in the pocket through the opening 3*a*.

In more detail, a production worker places the partially assembled blank as shown in FIG. 27 on a level surface with the pockets facing upwards, and applies a force downwards towards the main front cover 1 on the inserts 5 whilst sliding the inserts over the cover 1 into the pockets 3 in the direction of arrow 80. The interior of the cover 1 thus acts as a guide surface to steer the insert 5 into the pocket. Consequently, the inserts 5 will be quickly and accurately inserted into the pockets.

Figure 28:
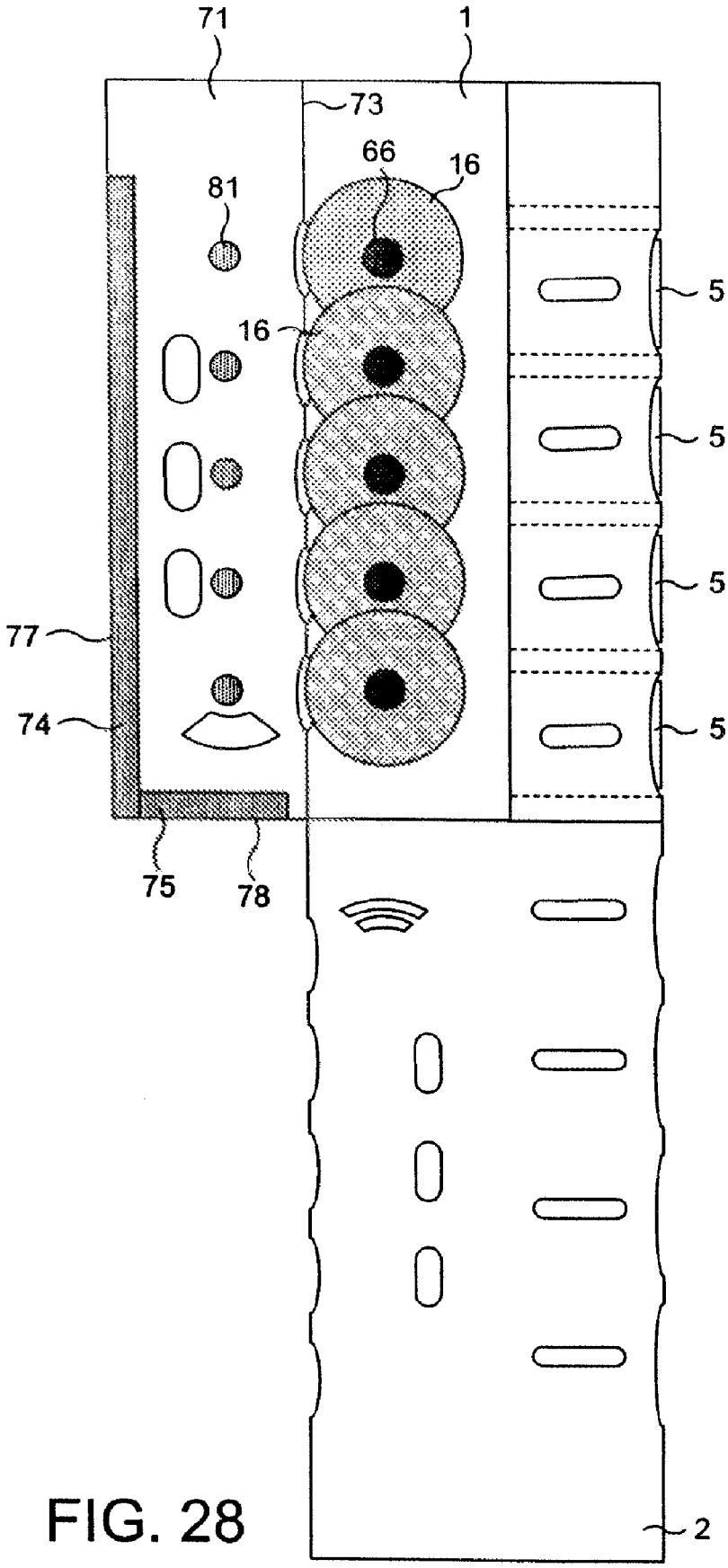
FIG. 28 illustrates how the wheels are assembled in the bookmark.
Figure 29:
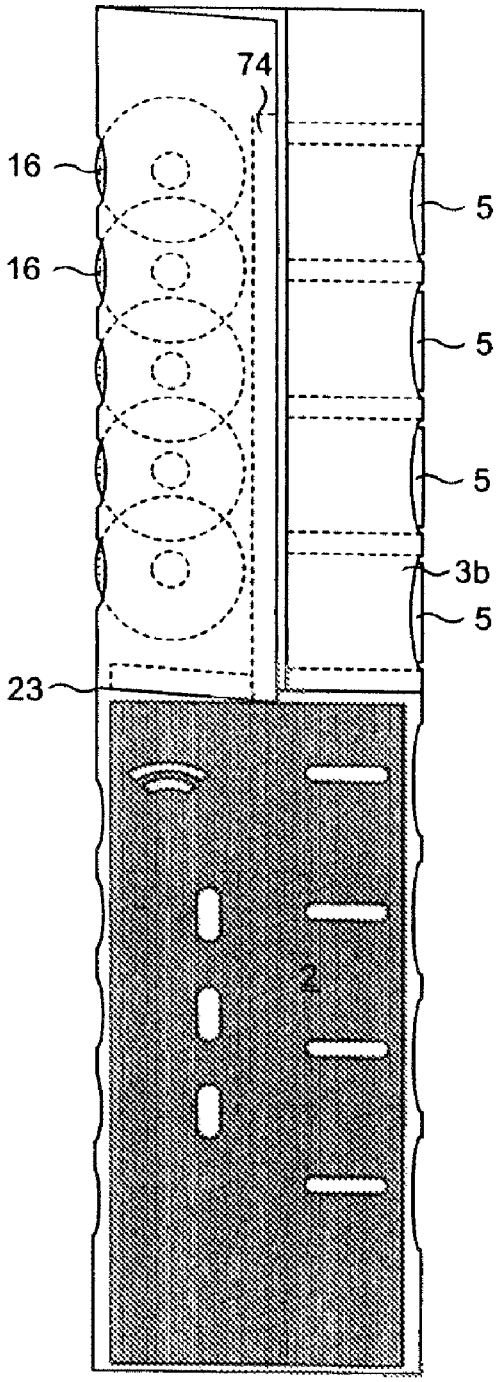
FIG. 29 illustrates how the blank is folded to enclose the wheels.
Figure 30:
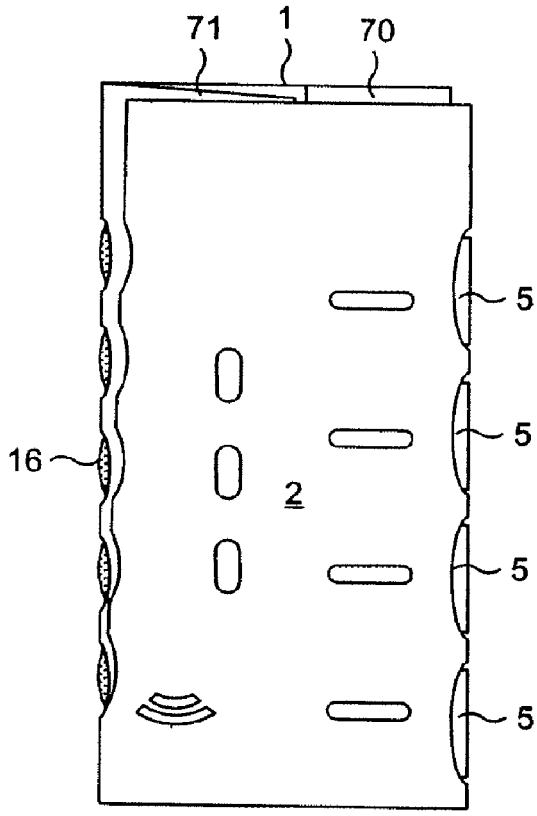
FIG. 30 illustrates how the blank is folded to obtain the finished bookmark.

FIG. 28 shows the next step in the fabrication process, during which the wheels 16 are mounted onto the bookmark blank. The wheels 16 are push-fitted onto the stub axles 66 as previously described with reference to FIGS. 22 and 23 in an overlapping relationship. An adhesive is applied to the surface of the blocking strips 74 and 75 in region 77 and 78 and to regions 81 corresponding to the position of distal ends 67 of the stub axles 66 when the second re-entrant portion 71 is folded onto main front cover 1. The second re-entrant portion 71 is folded over the main front cover along line 73 as shown in FIG. 29. The blocking strip 74 in region 77 defines the rear 3*b* of each of the pockets and ensures that the inserts 5 do not touch the wheels when received in the pockets. An adhesive is applied to the inside surface of cover 2 as shown by the shaded area in FIG. 29 and the cover is folded onto the front cover 1 along line 23. FIG. 30 shows the resulting, assembled bookmark from the rear, just before the cover 2 is adhered to the re-entrant portions 70, 71.

Figure 31:
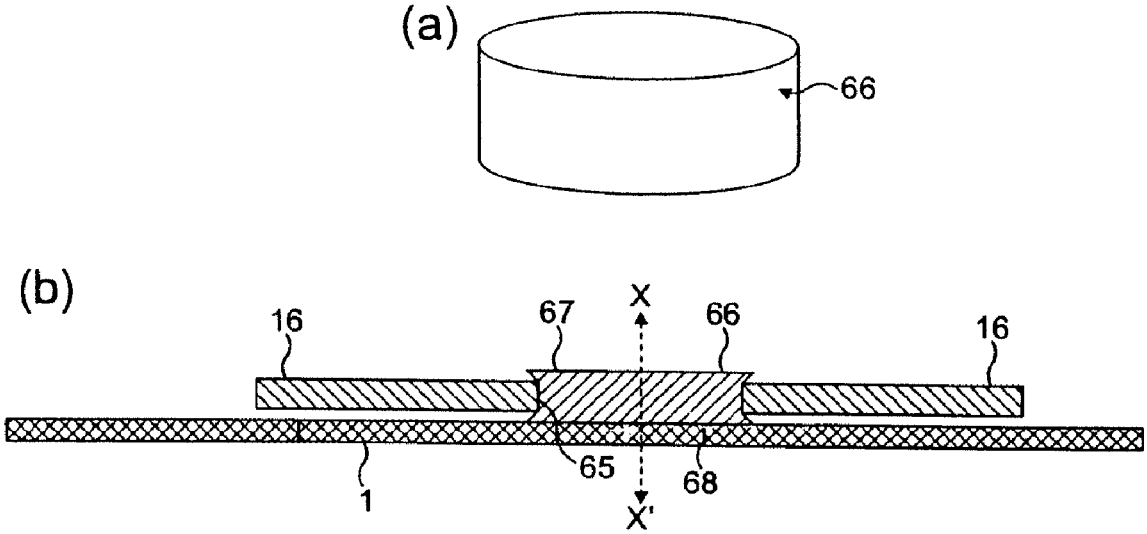
FIG. 31*a* shows another stub axle for the rotary wheel assembly.
FIG. 31*b* is a sectional view of the assembly shown in FIG. 31*a;*
Figure 32:
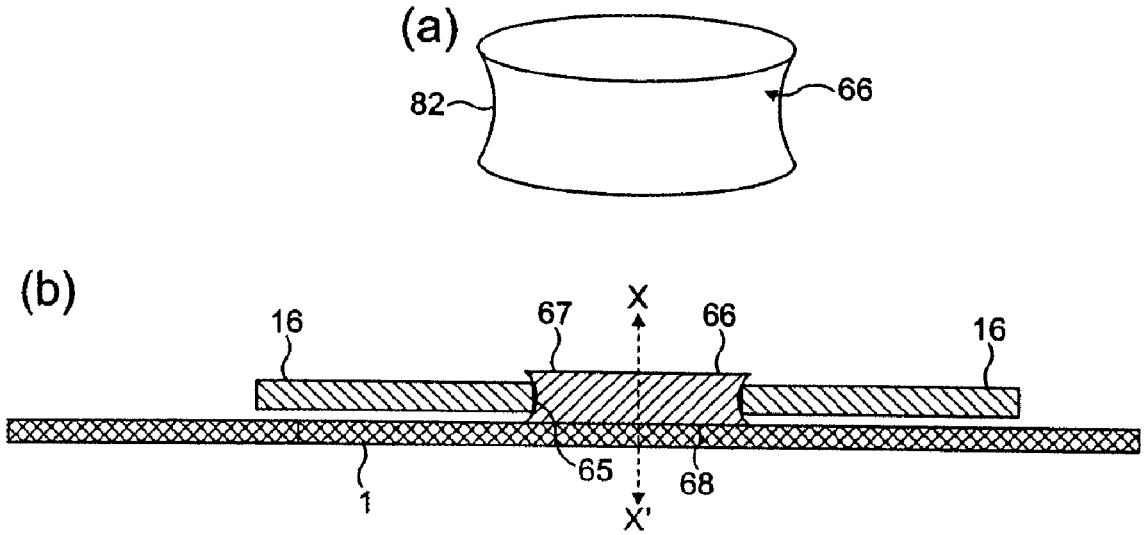
FIG. 32*a* shows yet another stub axle of the rotary wheel assembly.
FIG. 32*b* is a sectional view of the assembly shown in FIG. 32*a;*

FIGS. 31 and 32 illustrate alternative embodiments of the stub axle 66. FIG. 31*a* shows an embodiment of the stub axle made of an elastomeric material, which is generally cylindrical with the radii of the proximal and distal ends of the stub axle being substantially equal and greater than the radius of the opening 65 of the wheel 16. The stub axle 66 is typically attached to the substrate, provided by cover 1, using an adhesive. When the wheel 16 is push-fitted onto the stub axle, it applies a force around the circumference of the axle and the elastomeric material of the axle 66 is resiliently deformed to allow the wheel to pass onto the axle. The wheel 16 is not deformed significantly itself during the push fitting process. When fitted, the radius of the central portion of the stub axle 66 is reduced as compared with its proximal and distal ends as shown in FIG. 31*b*. Accordingly, the wheel is captured on the stub axle and can rotate about the axis X-X'. The elastomeric material of the stub axle 16 provides a sliding surface over which the wheel 16 can readily turn, allowing manual rotation of the wheel but also lightly gripping the wheel so that it retains its angular rotational position when released from manual rotation.

As shown in FIG. 32*a*, in another embodiment, the stub axle 66 is manufactured to have a concave cylindrical side surface 82 such that the radial dimension of the proximal and distal end regions 67, 68 is larger than the radial dimension of the central portion of the stub axle. The stub axle 66 can be attached to the substrate 1 using an adhesive. When the wheel 16 is push-fitted onto the stub axle 66, both the wheel 16 and the stub axle 66 are resiliently deformed and the wheel is captured around the centre of the stub axle as shown in FIG. 32*b*. The wheel 16 can be rotated about the axis X-X'. The stub axle 66, according to this embodiment, is made out of cardboard, plastic or paper. The shape of the stub axle in this embodiment provides an air gap between the wheel and the substrate. The air gap reduces the friction between the wheel and the substrate and allows easier rotation of the wheel.

Figure 33:
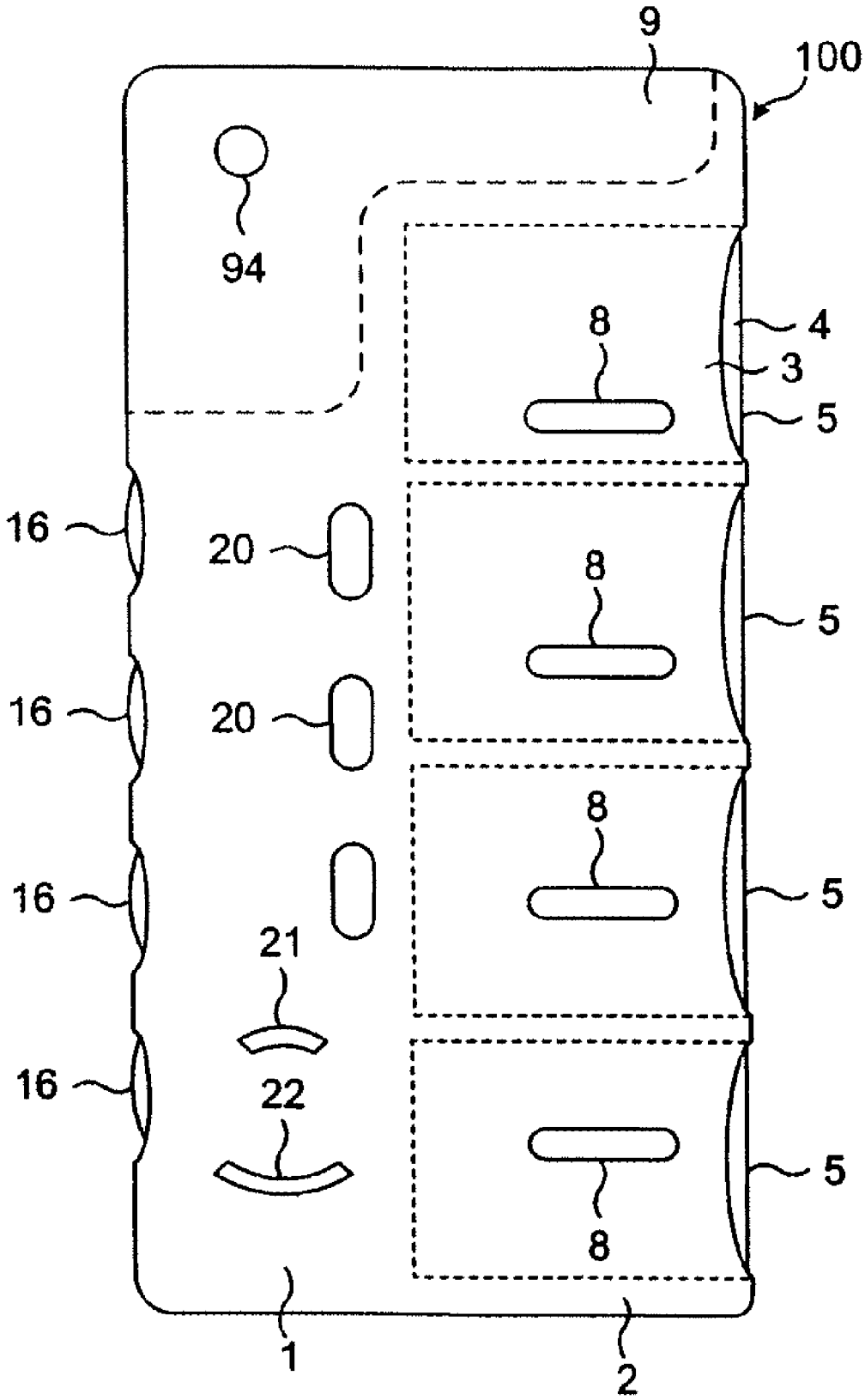
FIG. 33 is a front view of another embodiment of a device according to the invention.
Figure 34:
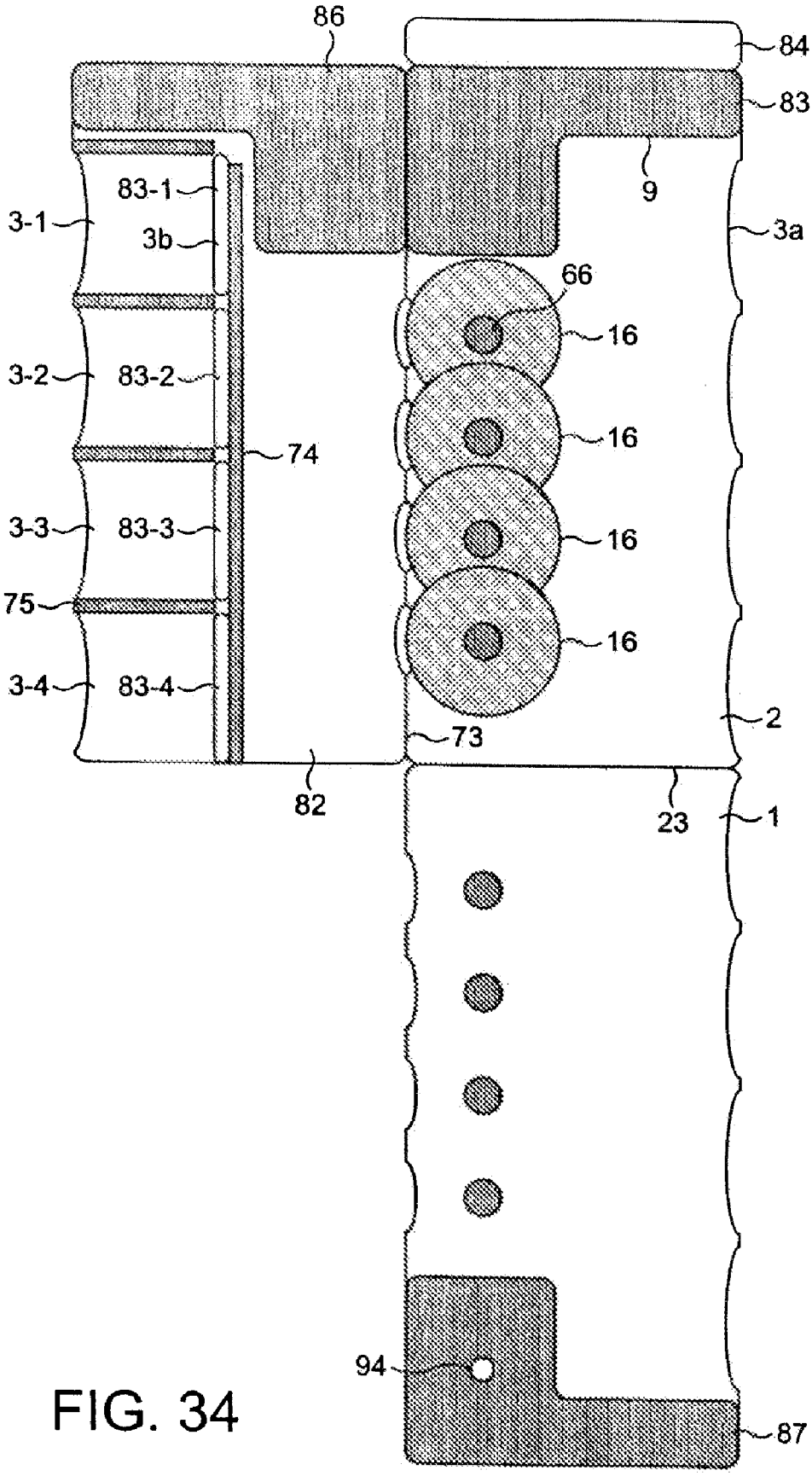
FIG. 34 is a plan view of a blank for fabricating the device shown in FIG. 33.

Another embodiment for the device is illustrated in FIG. 33 and a blank for use in forming the device is shown in FIG. 34. The device comprises a front and rear main cover 1, 2 which, as previously described, includes pockets 3 that contain inserts 5. Wheels 16*a-d* mounted on axles 66 cooperate with windows 20, 21, 22 as previously described. Windows 18 are provided to display the contents of pockets 3.

The device is fabricated from a blank shown in FIG. 34, in a manner generally similar to that described with reference to FIGS. 24-30. The blank shown in FIG. 34 has a main re-entrant portion 82. The device has four pockets 3-1; 3-4 defined between blocking strips 75. Blocking strip 74 is arranged to the rear of each pocket 3.

Considering the pocket 3-1, it has a front 3*a* and rear 3*b*. A slot 83-1 extends across the rear of the pocket 3-1, with corresponding slots 83-2, 3, 4 at the rear of the pockets 3-2, 3, 4.

To assemble the device, the wheels 16, are placed on stub axles 66 previously glued on cover 2 in the manner previously described. Thereafter, the re-entrant portion 82 is folded along line 73 so as to overly the rear cover portion 2. The distal ends of the axles 66 together with the strips 74, 75, are provided with a coating of adhesive so that when the re-entrant portion 82 is folded over the cover 2, the axles are located in place and the wheels are covered by the re-entrant portion 82. Also, the pockets 3 are formed between the re-entrant portion 82 and the cover 2, between the strips 74, 75, on the right hand side of the cover 2 shown in FIG. 34. Access to the rear 3*b* of the pockets can be achieved through the access openings 83-1; 4. Inserts 5 are thus inserted through the access openings 83-1; 4, using the folded re-entrant portion 82 as a guide surface.

An electronics package to be described in more detail hereinafter, may be placed overlying shaded region 83 on the rear cover 2. This corresponds to pocket region 9 of the previous examples. The package may be placed on the cover 2 before the re-entrant portion 82 is folded into position and thereafter held in place by flap 84 which forms part of the blank that can be folded to overly the package and hold it in place within the device. When folded, shaded region 86 of re-entrant portion 82 overlies region 83 on the cover.

The front cover 1 is then folded along line 23 to overly the folded, re-entrant portion 82. The cover 1 is glued in place and as a result, the access openings 83 to the rear open pockets 3, become closed thereby securely holding the inserts 5 within the pockets. Shaded region 87 on the interior of cover 1 then overlies shaded region 85 of cover 2, defining area 9 available to receive an electronics package.

Figure 35:
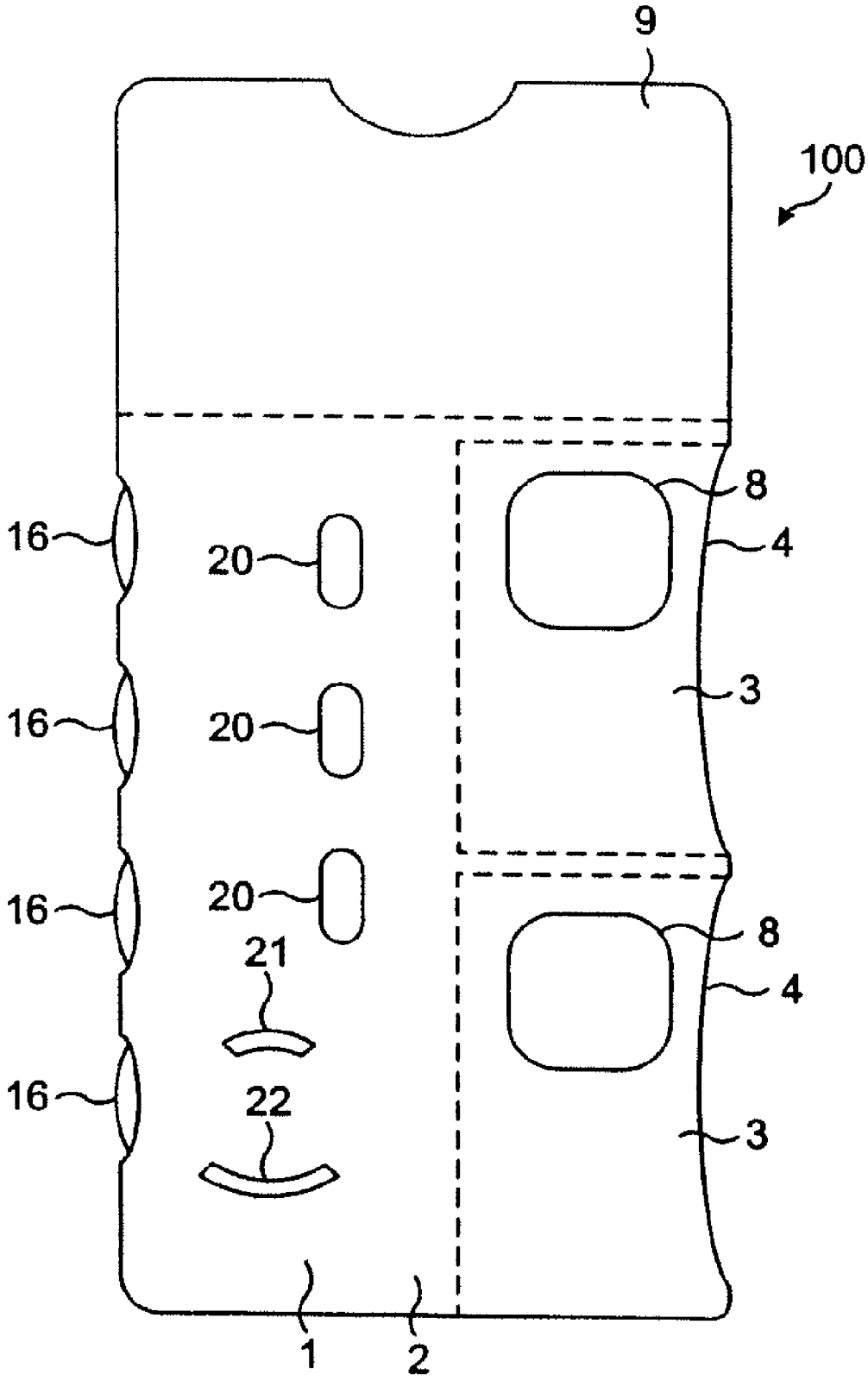
FIG. 35 is a front view of another embodiment of a device according to the invention.
Figure 36:
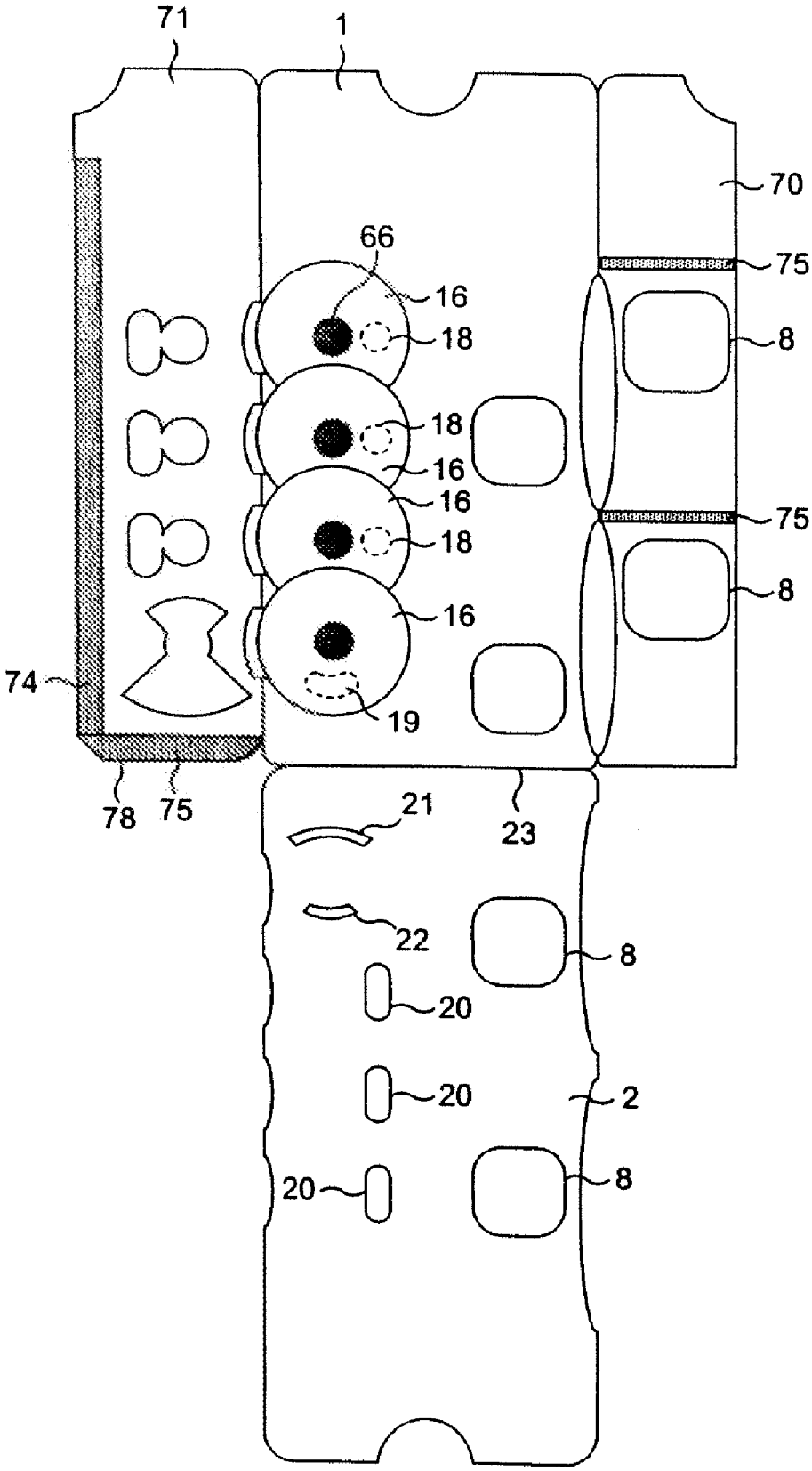
FIG. 36 is a plan view of a blank for fabricating the device shown in FIG. 35.
Figure 37:
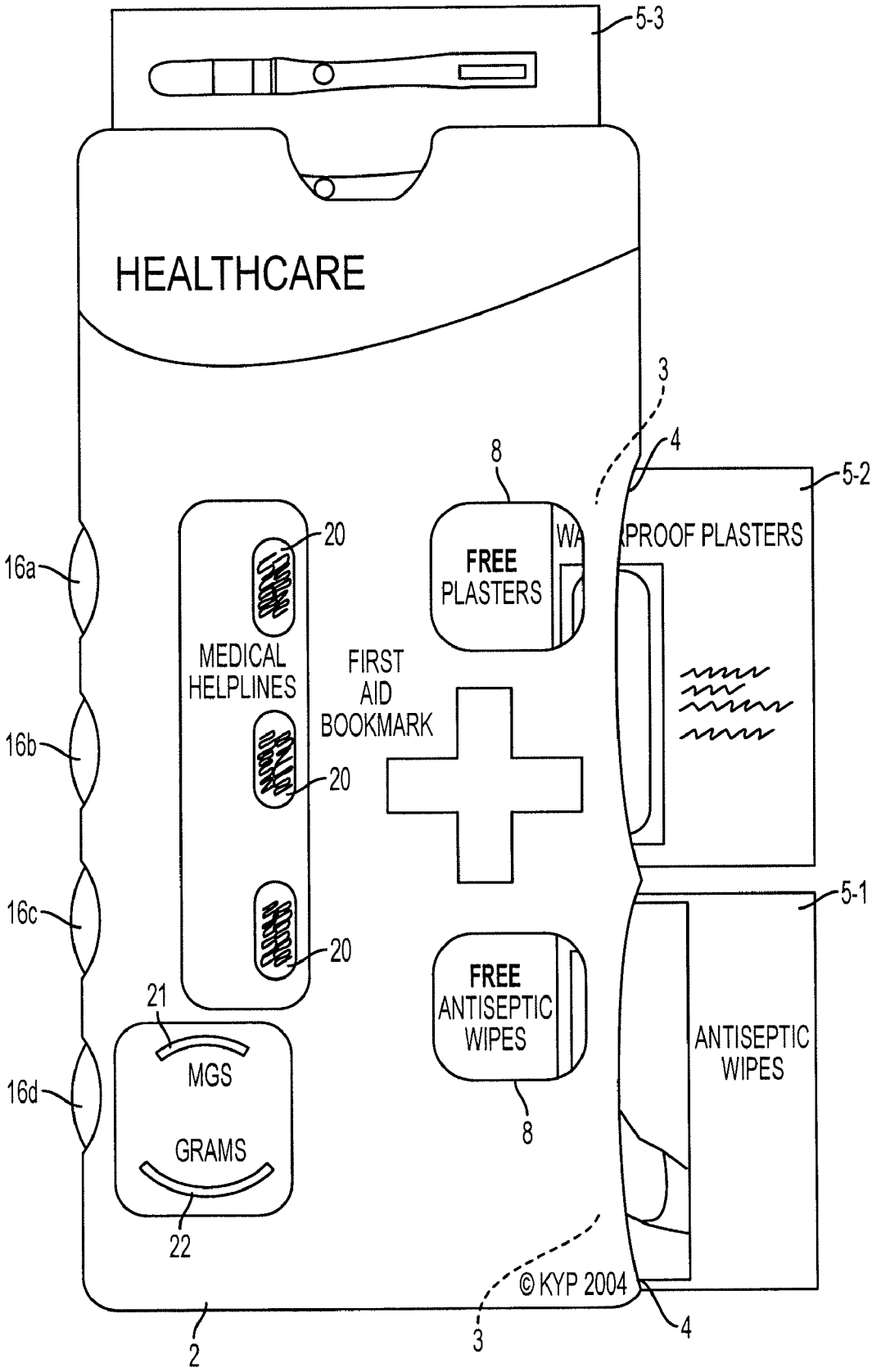
FIG. 37 is a front view of the device of FIGS. 35 and 36 showing its inserts and legends on its cover.

Another version of the device is illustrated in FIGS. 35 to 37. This version has two pockets 3 with relatively large openings 8 to reveal details of the inserts 5-1, 5-2 shown in FIG. 37. The device also a third pocket 9 shown in FIG. 35, which receives a further insert 5-3 shown in FIG. 37. The construction and assembly of the device shown in FIGS. 35-37 is generally similar to that described with reference to FIGS. 24-30 and corresponding parts are marked with the same reference numbers. Referring to FIG. 37, the device is configured for use as a promotional tool in relation to healthcare and appropriate legends relating to healthcare are printed on the covers 1, 2. The device may be configured as a free gift, for example to be included in mail shots from a medical insurance company or for example to be included with insurance premium renewal notices mailed to policy holders. The device may be used as a bookmark or solely as a promotional device. In this example, the inserts 5-1, 5-2 contain free samples of antiseptic wipes and waterproof plasters, with the contents of the pockets being clearly visible through windows 8. The pocket 9 contains the further insert 5-3, which in this example includes disposable thermometers.

The wheels 16*a-c* upon rotation display the telephone numbers of different medical help lines, suitable for different medical conditions. The wheel 16*d* cooperates with windows 21, 22 to act as a converter for converting one unit of weight to another.

Figure 38:
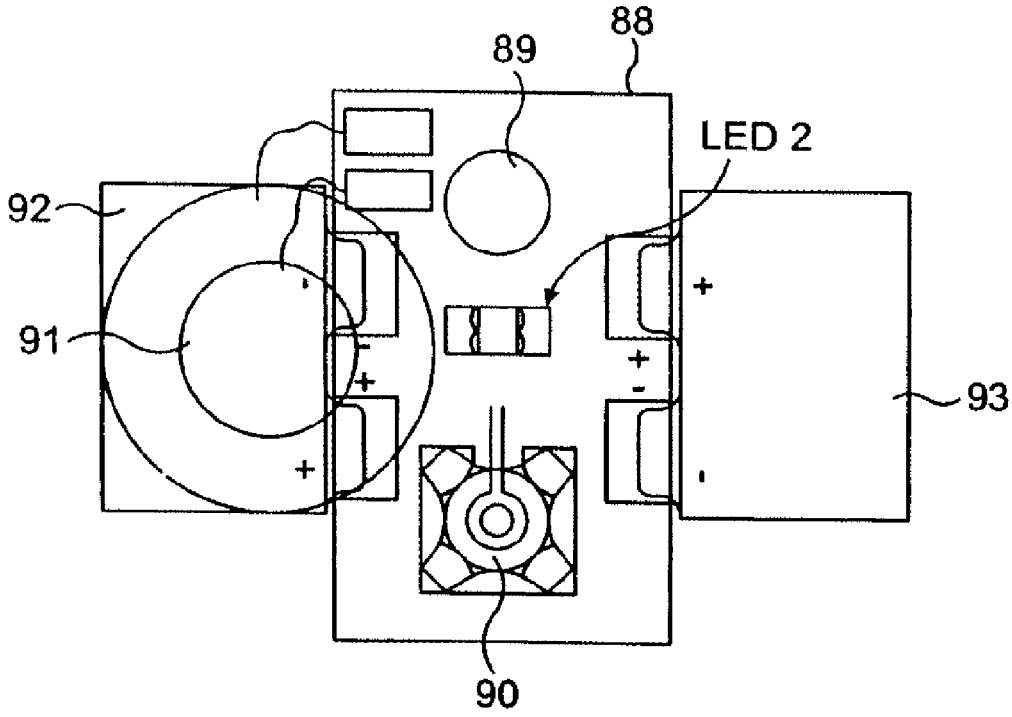
FIG. 38 is a schematic illustration of an electronics package to be included in the device.
Figure 39:
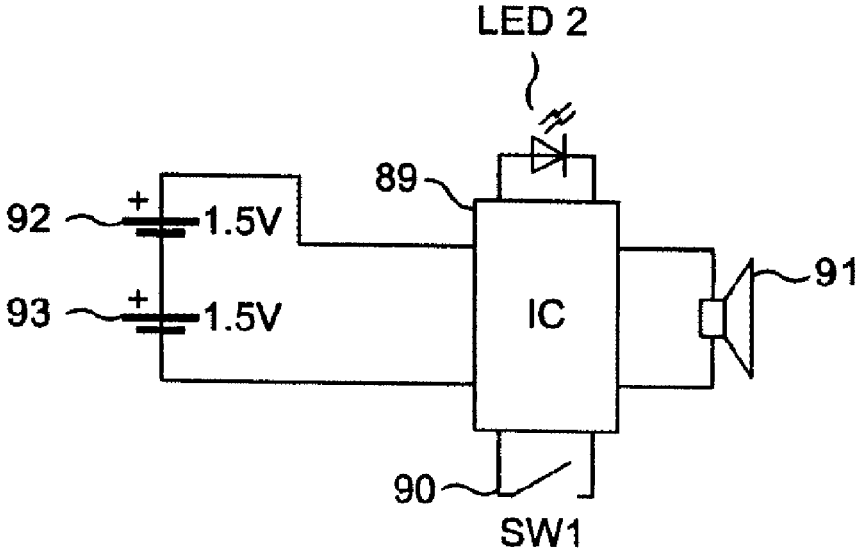
FIG. 39 is a circuit diagram of the electronics package.

FIG. 38 illustrates an example of an electronics package to be included in the region 9 of the device. The package comprises a circuit board 88 on which an integrated circuit (IC) semiconductor chip 89 is mounted together with a light emitting diode LED 2 and a planar metal press-switch 90 and a sound emitting device 91. LED 2 may be driven by circuitry as described in GB 2,336,657 supra. The circuit is powered by paper batteries 92, 93 as manufactured by Power Paper Ltd, POB 3353, Israel 49130, although conventional, generally flat batteries could also be used. The circuitry of the electronics package is illustrated in FIG. 39.

Referring again to FIGS. 33 and 34, the light emitting diode LED 2 is configured to emit light through opening 94 in the front cover 1. The press switch 90 can be operated manually by squeezing together the front and rear covers 1, 2 so as to make an electrical connection within the switch 90 for the period that the device is compressed. Alternatively, the switch 90 may be a bistable device operable to make and break the connection on successive operations.

The chip 89 can be programmed to perform a number of different functions. For example, the chip 89 may be configured as a tone dialler in order to emit dialling tones such as dual tone multi-frequency (DTMF) telephone dialling tones. The advertising material printed on the front and rear main cover 1, 2 of the device may relate to a chain of pizza parlours and the chip 89 may be configured to emit a sequence of DTMF tones corresponding to the telephone number on ordering a pizza. In this way, the user can automatically dial for a pizza by operating switch 90 and holding the device close to the microphone of a telephone handset. In another embodiment, the chip 89 is configured to act as a timer, e.g. an egg timer so as to produce an audible sound from the sound emitting device 91 and/or a flashing light by means of LED 2, to indicate when the timer times out.

In another embodiment, the chip 89 is configured to include an integral gas analyser for analysing alcohol content in a user's breath, for use as a breathalyser to determine whether the user is fit to drive an automobile. In further embodiments, the chip 89 can comprise a radio receiver, a clock or a calculator. Many modifications to the arrangement shown in FIG. 38 can be made and for example, the paper batteries may not have simple rectangular shapes but instead can be configured to fill the entire space of the receptacle 9 or elsewhere between the covers 1, 2 in order to maximise the power capacity of the device. Also, the re-entrant portion 82 and/or the front and rear covers 1, 2 may be provided on their inside with printed batteries.

In another embodiment, the electronics package within the receptacle 9 is configured to detect radio frequency identification (RFID) tags which may be applied to the user's luggage, to enable the user to locate their luggage, for example on a carousel at an airport.

Referring to FIG. 33, the inserts 5 included in pockets 3 in this example comprise self-adhesive RFID tags which can be removed by the user and adhered to items of luggage. RFID tags are well-known per se and one example is the TI-rf ID TI tag manufactured by Texas Instruments for operation according to International Standard ISO 15693 in the 13.56 Mhz frequency band. The tags 5 have a layer of self-adhesive material covered by a backing strip which can be removed to allow the tag to be adhered to an item of luggage.

Figure 41:
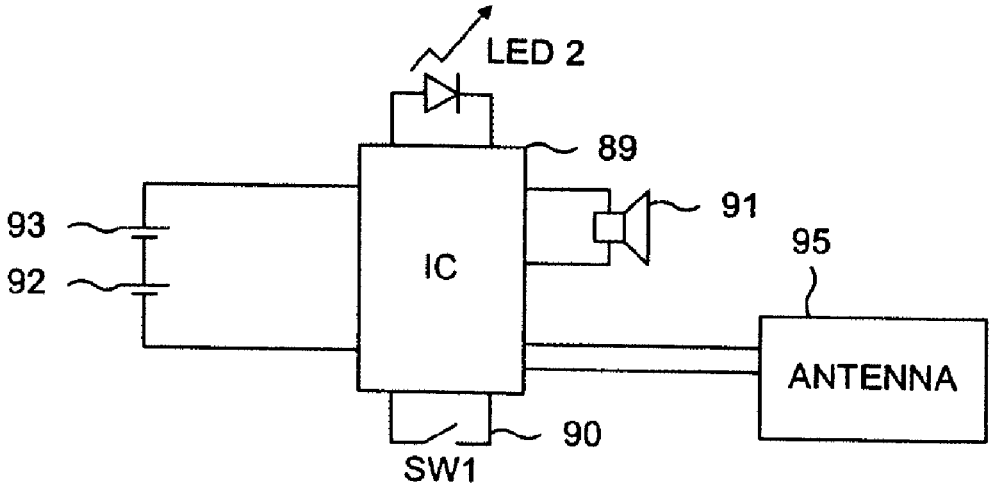
FIG. 41 is a schematic perspective view of use of the device to detect RFID luggage tags at an airport carousel.

The circuitry for the electronics package to be included in receptacle 9 is shown in FIG. 41 and is generally similar to the circuitry of FIG. 39 but with the addition of an antenna 95 for transmitting interrogation pulses and receiving returns from RFID tags.

As well known in the art, RFID tags are programmed with an individual code so that when interrogated with an RF pulse, they produce a return corresponding to the code. The antenna 95 detects RFID returns and the circuit 89 demodulates and compares them with stored values corresponding to the code stored on the tags that comprise the inserts 5.

Figure 40:
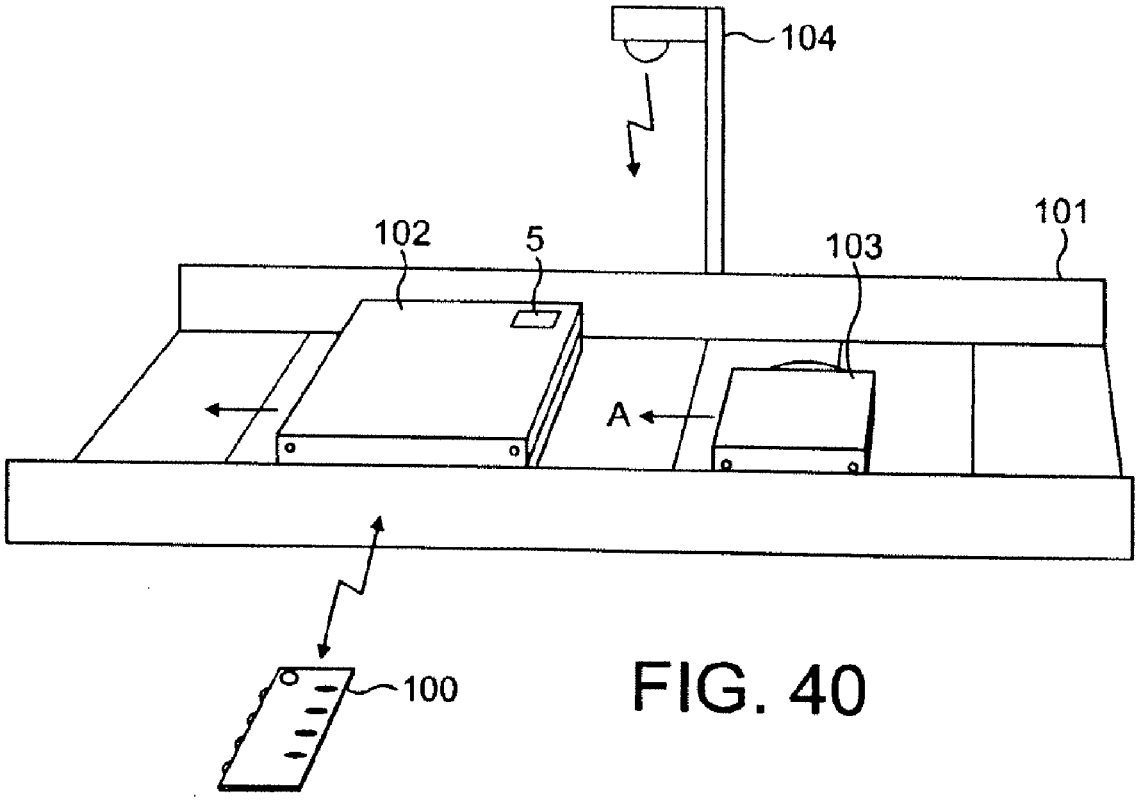
FIG. 40 is a circuit diagram of the electronics package for use with RFID tags.

FIG. 40 illustrates the RFID tagging system in use. The device 100 is held by a user in the vicinity of luggage carousel 101 along which bags 102, 103 travel in a direction of arrow A. Before the journey, the user removed one of the RFID tags 5 shown in FIG. 33 from its pocket 3 and adhered it to suitcase 102. In order to locate the suitcase 102 at the end of the journey on a carousel 101, the user activates switch 90 so as to cause IC 89 to emit RFID interrogation pulses. When suitcase 102 moves into the vicinity of device 100, the RFID tag 5 produces a characteristic return, which is received by antenna 95 and fed to IC 89, where it is demodulated and compared with stored values corresponding to the digital codes for the RFIDs supplied with the device 100. When this occurs, a sound is emitted through sound emitting device 91 and/or LED 2 is illuminated to signify to the user that the suitcase 102 is in the vicinity of the device 100.

The antenna 95 may be of any suitable design and may for example comprise a printed circuit pattern on the interior surface of cover 1 with dipole elements suitably configured to provide an appropriate directive pattern.

Many modifications to the described RFID system are possible. For example, the airport may have its own RFID detection system powered by transponder 104 shown in FIG. 38. In this situation, the device 100 may operate in a receive-only mode, in which responses from RFID tags are stimulated by the transponder 104 rather than device 100 itself. Such an arrangement substantially reduces the power consumption in the device 100 and thereby extends battery life.

In another modification, the device 104 both transmits and receives data from RFID tags and then transmits the received data to a further station (not shown). In this situation, the device 100 may be configured to eavesdrop upon the data transmissions from the device 104 without the need to pick up returns from the RFID tags directly.

Figure 42:
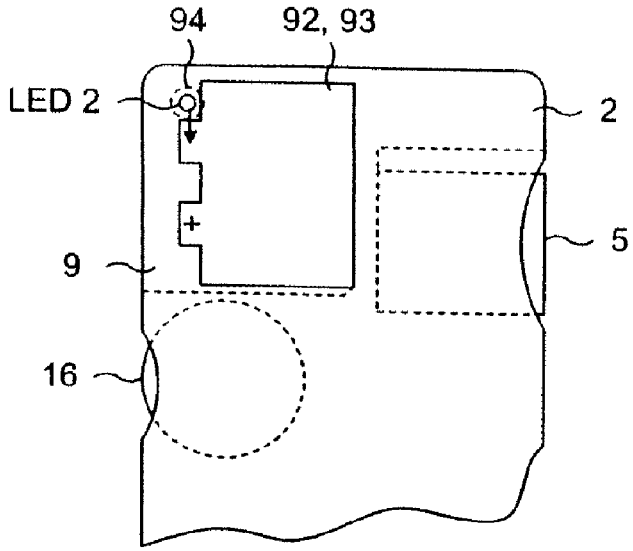
FIG. 42 is a partial front view of the device showing a paper battery configuration to drive a LED through a switch.
Figure 43A:
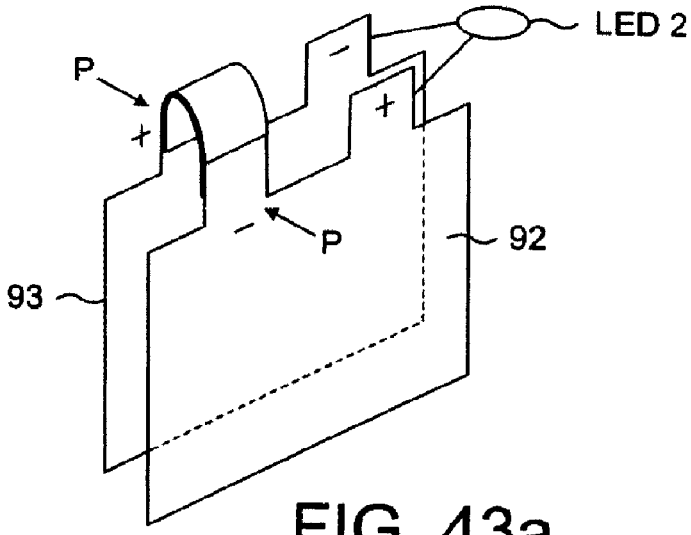
FIGS. 43*a* and 43*b* illustrate the switch and battery configuration in more detail.
Figure 43B:
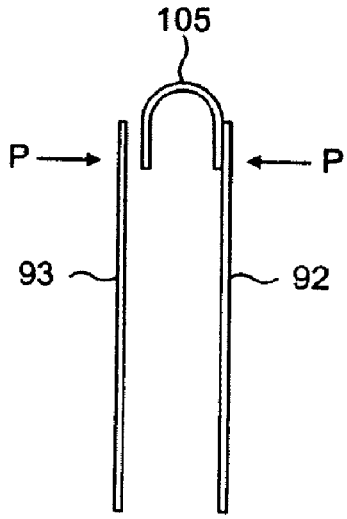

FIGS. 42 and 43 illustrate an alternative arrangement of paper batteries for use in the device. The receptacle 9 contains first and second overlying paper batteries 92, 93 which may be generally of the type described with reference to FIGS. 38 and 39. The paper batteries 92, 93 have respective positive and negative terminals as shown, each battery having a nominal voltage of 1.5v. The batteries 92, 93 overly one another with adjacent terminals arranged to be of opposite polarity. The light emitting diode LED 2 is connected to terminals of opposite polarity of the two batteries 92, 93. An electrically conductive spring contact 105 is attached to the negative terminal of battery 92. The LED is illuminated by manually compressing the front and rear covers 1, 2 so as to press batteries 92, 93 towards one another in a direction of arrows P. In this way, contact 105 is electrically connected to the positive terminal of battery 93 so as to complete a circuit for LED 2, thereby switching on the diode. The natural resilience of the covers 1, 2 and the spring contact 105 ensures that the circuit is broken when the covers are released. Thus the arrangement provides a convenient and inexpensive push-switch arrangement. The arrangement of FIGS. 42 and 43 can be modified to include the circuit board 88 and associated circuit components illustrated and described with reference to FIGS. 38-41.

Figure 44:
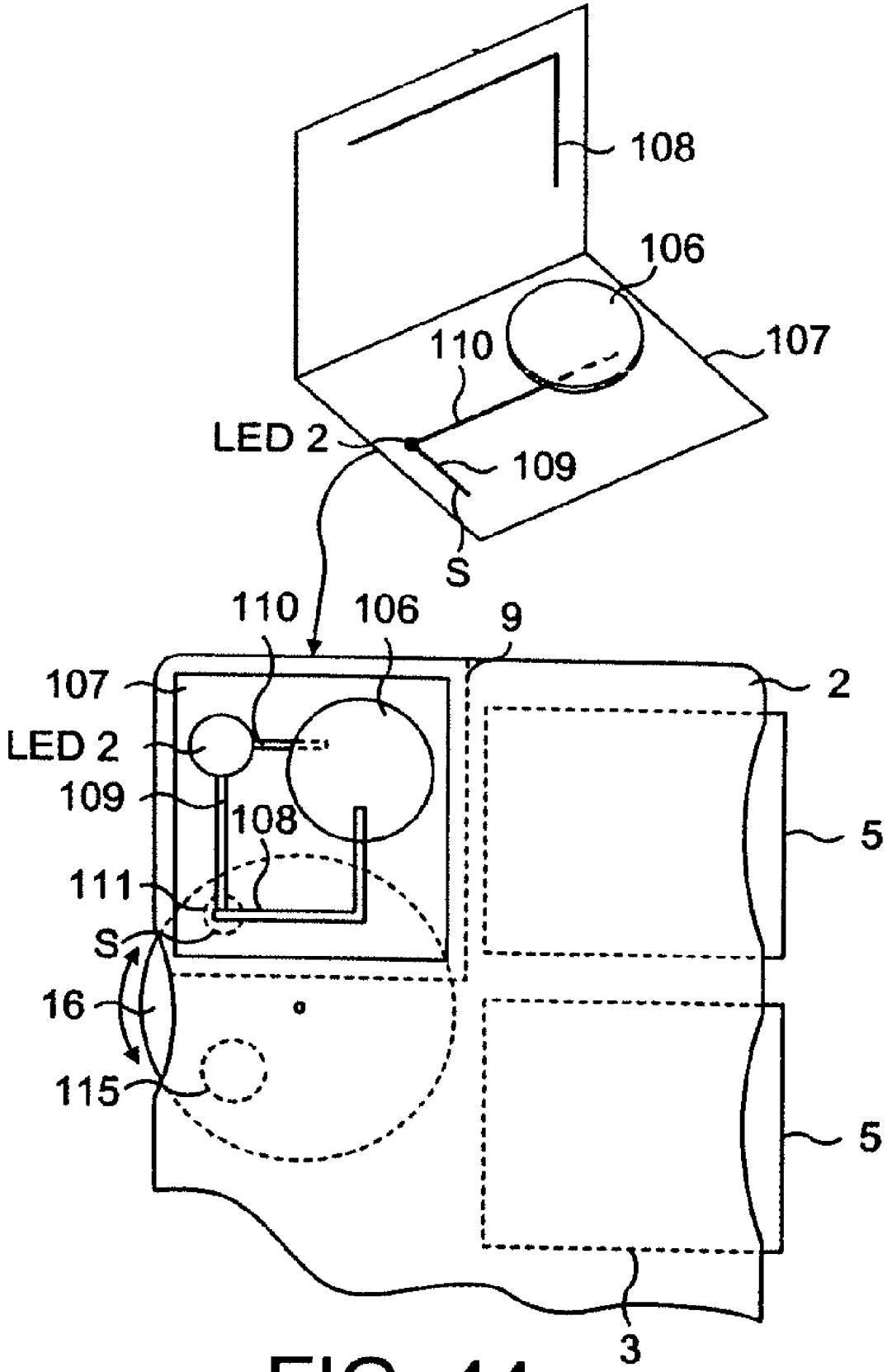
FIG. 44 is a partial front view of the device showing a battery and rotary to drive a LED, the switch being shown in exploded view.
Figure 45:
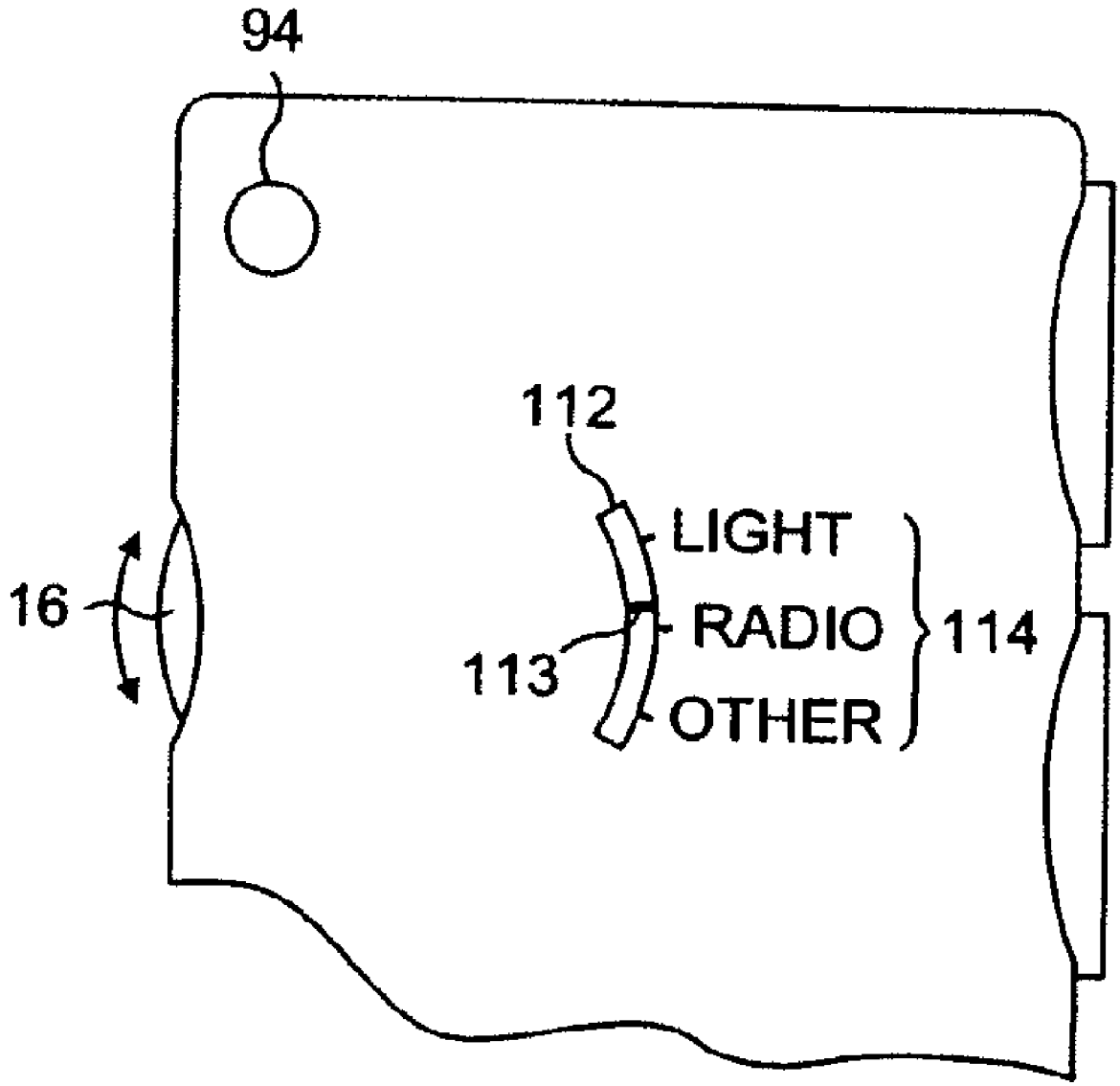
FIG. 45 shows the cover member of the device shown in FIG. 44 in more detail.

A further switching arrangement is illustrated in FIGS. 44 and 45. This arrangement uses a flat, circular lithium battery 106 that has positive and negative terminals on its opposite circular faces. The battery 106 is attached to a rectangular, folded plastics membrane 107 with printed circuit patterns 108, 109, 110 on its surface. An amber light emitting diode LED 2 is surface mounted on the membrane 107 with its terminals electrically connected to printed circuit patterns 109, 110 respectively. Pattern 110 is also connected to one terminal of the battery 106. The other terminal of the battery 106 is connected to circuit pattern 108 and the circuit is completed through a switching region S. During manufacture, the membrane 107 is folded into a flat package and inserted into receptacle 9 in the device. One of the wheels 16 is configured as a rotary switch with a switching contact 111 thereon. The wheel 16 rotates between the two folded portions of the membrane 107 so as to bring the switching contact 111 into the switching region S. When so located, the contact 111 completes the circuit between the two battery terminals through LED 2, by forming an electrical connection between the ends of the circuit patterns 108, 109 in the switching region S.

The switching action of wheel 16 shown in FIG. 44 can be developed to operate other electrical apparatus (not shown) within the device and a window 112 may be provided to cooperate with a marker 113 on wheel 16, so that by aligning the marker with indicia 114 individual electrical circuitry can be switched on and off. For example, the device may include broadcast radio circuitry or RFID circuitry as previously described and appropriate contacts on the wheel 16 may be provided for such circuitry, such as contact 115 shown in FIG. 44. This contact is configured to cooperate with further stationary contacts (not shown) to enable energisation of such additional circuitry in the device.

The bookmarks need not necessarily be configured as described herein and other bookmark designs could be used. Also, the bookmarks need not necessarily be configured in different versions and the same advertising material can be supplied for all the different categories of book titles. Also, the bookmarks need not necessarily be only distributed at no cost to the customer and they can be supplied directly to the retailers for sale at a non-zero price.

The bookmarks described herein may also be used as promotional tools, which are provided with promotional inserts or advertising material specific to a particular promotional project. Such promotional tools need not necessarily be supplied with books at the point of sale as previously described, and may instead be distributed to support the launch of any new product or service, for example as a free gift.

For example, the device may be configured for use as a promotional tool for inclusion in a so-called goody bag provided to tourists. The goody bag may contain airline tickets or other travel documentation. The device according to the invention may be used as a promotional tool with targeted advertising thereon, with promotional items as inserts in the pockets. For example, an airline can promote its in-flight duty free services with advertising copy on the device, and the inserts may comprise samples of items available for purchase duty free.

The bookmark has been described primarily with five rotatable wheels and four pockets. It will however be evident to the skilled reader that the device can be assembled with any practicable number of wheels and pockets. Moreover, the invention is not limited to the size of the pockets and wheels described in the embodiments of the bookmark described above. The details of the blank may be modified to adjust for different sized pockets and devices.

Moreover, the invention is not limited to be used in the assembly of a bookmark bearing advertising material printed thereon. The blank described with reference to FIGS. 7 and 8 or FIGS. 24 to 30 may be used as an advertising medium having no relation to bookmarks or it may be decorated to be used as a novelty item wherein the pockets constitutes frames for photos etc and the information printed on the wheels relates to the date or a count down to some special event important to the user of the novelty item. Moreover, the rotary wheel assemblies may be used separately in toys.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A device for promotional purposes comprising:

a generally rectangular sheet material with a first and a second side edge, the first side edge having a plurality of cut-outs;

a plurality of rotatable disks mounted for manual rotation disposed in said device and protruding through said cut-outs to allow the disks to be rotated by a user;

at least one pocket formed by the sheet material, the pocket having an opening along said second side edge;

at least one insert, the insert being insertable and fully removable through the opening of the at least one pocket; and at least one window in the sheet material for displaying information on one of said rotatable disks dependent on its position of angular rotation, wherein the device displays promotional material.

2. The device of claim 1, wherein the sheet material is folded to provide said first side edge.

3. The device of claim 1, wherein the at least one window extends in a direction generally perpendicular to said first side edge.

4. The device of claim 1, wherein the plurality of rotatable disks have overlapping peripheries.

5. The device of claim 1, wherein the plurality of rotatable disks are made of paper, cardboard, plastic or fibreboard.

6. The device of claim 1, wherein the at least one window comprises two windows for displaying related messages on the plurality of rotatable disks.

7. The device of claim 6, wherein the related messages are provided on a single disk of said plurality of rotatable disks.

8. The device of claim 1, wherein at least one of the plurality of disks has two sides with messages thereon, wherein the at least one window comprises windows at positions corresponding to portions of said two sides of the disks for displaying said messages dependent on the positions of angular rotation to the disks.

* * * * *